US010257619B2

(12) United States Patent
Vanpoucke et al.

(10) Patent No.: US 10,257,619 B2
(45) Date of Patent: Apr. 9, 2019

(54) OWN VOICE BODY CONDUCTED NOISE MANAGEMENT

(71) Applicant: Cochlear Limited, Macquarie University, NSW (AU)

(72) Inventors: Filiep J. Vanpoucke, Huldenberg (BE); Scott Allen Miller, Boulder, CO (US)

(73) Assignee: Cochlear Limited, Macquarie University, NSW (AU)

( * ) Notice: Subject to any disclaimer, the term of this patent is extended or adjusted under 35 U.S.C. 154(b) by 843 days.

(21) Appl. No.: 14/546,610

(22) Filed: Nov. 18, 2014

(65) Prior Publication Data

US 2015/0256949 A1 Sep. 10, 2015

Related U.S. Application Data

(60) Provisional application No. 61/948,230, filed on Mar. 5, 2014.

(51) Int. Cl.

| | |
|---|---|
| ***H04R 25/00*** | (2006.01) |
| *G10L 21/0208* | (2013.01) |
| *G10L 25/18* | (2013.01) |

(52) U.S. Cl.

CPC ..... *H04R 25/453* (2013.01); *H04R 25/606* (2013.01); *G10L 21/0208* (2013.01); *G10L 25/18* (2013.01); *G10L 2021/02087* (2013.01); *H04R 2460/13* (2013.01)

(58) Field of Classification Search

CPC ..... H04R 25/453; H04R 25/606; H04R 2460/13; G10L 21/0208; G10L 2021/02087; G10L 25/18

See application file for complete search history.

(56) References Cited

U.S. PATENT DOCUMENTS

| | | | | |
|---|---|---|---|---|
| 6,888,949 | B1 * | 5/2005 | Vanden Berghe ... | H04R 25/505 381/312 |
| 7,853,031 | B2 | 12/2010 | Hamacher | |
| 8,096,937 | B2 | 1/2012 | Miller, III | |
| 8,472,654 | B2 | 6/2013 | Miller, III | |
| 8,744,100 | B2 * | 6/2014 | Kojima ..... | H04R 25/407 381/312 |
| 2003/0165246 | A1 * | 9/2003 | Kvaloy ..... | H04R 1/1016 381/312 |
| 2003/0171787 | A1 | 9/2003 | Money et al. | |
| 2007/0009122 | A1 * | 1/2007 | Hamacher ..... | H04R 25/453 381/312 |
| 2007/0167671 | A1 * | 7/2007 | Miller, III ..... | H04R 25/606 600/25 |

(Continued)

OTHER PUBLICATIONS

International Search Report and Written Opinion for PCT/IB2015/051316, dated Apr. 29, 2015.

(Continued)

*Primary Examiner* — Davetta W Goins
*Assistant Examiner* — Kuassi Ganmavo
(74) *Attorney, Agent, or Firm* — Pilloff & Passino LLP; Martino J. Cosenza

(57) ABSTRACT

A system, including an adaptive noise cancellation sub-system, wherein the system is configured to adjust operation of the sub-system from a first operating state to a second operating state upon a determination that operation of the adaptive noise cancellation sub-system will be effectively affected by an own voice body conducted noise phenomenon.

16 Claims, 16 Drawing Sheets

(56) References Cited

U.S. PATENT DOCUMENTS

| | | | | |
|---|---|---|---|---|
| 2009/0112051 | A1* | 4/2009 | Miller, III | A61B 5/721 600/25 |
| 2009/0187065 | A1* | 7/2009 | Basinger | A61N 1/36032 600/25 |
| 2010/0260364 | A1* | 10/2010 | Merks | H04R 25/407 381/313 |
| 2011/0098785 | A1 | 4/2011 | Lakshmi | |
| 2012/0232333 | A1* | 9/2012 | Miller, III | H04R 25/606 600/25 |
| 2013/0079634 | A1 | 3/2013 | Kerber | |
| 2013/0156208 | A1* | 6/2013 | Banba | G10L 21/0208 381/60 |
| 2015/0228292 | A1* | 8/2015 | Goldstein | G10L 21/0208 381/71.6 |

OTHER PUBLICATIONS

Kaibao Nie et al., 'Encoding Frequency Modulation to Improve Cochlear Implant Performance in Noise', In: IEEE Transactions on Biomedical Engineering, Jan. 2005, vol. 52, Issue 1, pp. 64-73 ("http://ieeexplore.ieee.org/xpls/abs_all.jsp?arnumber=1369589").

Extended European Search Report for EP Application No. 15 759 082.9, dated Jun. 27, 2017.

Herman A. Jenkins et al., Speech Perception Comparisons Using an Implanted and an External Microphone in Existing Cochlear Implant Users, Otology & Neurotology, 2012, vol. 33, No. 1, Department of Otolaryngology, University of Colorado School of Medicine, Aurora, Colorado, U.S.A.

* cited by examiner 142
136
100

10
132
130
120
126
118
119
108
109
111
112
114
146
103
148
140
147
134
122
123
121
116
104
106
110
102
105
107
101

OWN VOICE BODY CONDUCTED NOISE MANAGEMENT

CROSS-REFERENCE TO RELATED APPLICATIONS

This application claims priority to Provisional U.S. Patent Application No. 61/948,230, entitled OWN VOICE BODY CONDUCTED NOISE MANAGEMENT, filed on Mar. 5, 2014, naming Filiep J. VANPOUCKE of Mechelen, Belgium, as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. One example of a hearing prosthesis is a cochlear implant.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as cochlear implants convert a received sound into electrical stimulation. The electrical stimulation is applied to the cochlea, which results in the perception of the received sound.

Another type of hearing prosthesis uses an actuator to mechanically vibrate the ossicular chain, whereby an amplified signal can reach the cochlea. This type of hearing prosthesis can have utility for both conductive losses and sensorineural loss, depending on the level of hearing loss.

SUMMARY

In accordance with an exemplary embodiment, there is a system, comprising an adaptive noise cancellation sub-system, wherein the system is configured to adjust operation of the sub-system from a first operating state to a second operating state upon a determination that operation of the adaptive noise cancellation sub-system will be affected by an own voice body conducted noise phenomenon.

In accordance with another exemplary embodiment, there is a method, comprising outputting first signals from an implanted transducer while a recipient is vocally silent that are based at least in part on non-own-voice body conducted noise, and subsequently outputting second signals from the implanted transducer while a recipient thereof is vocalizing that are based at least in part on own-voice body conducted noise, the body noises being conducted through tissue of the recipient of the implanted transducer, processing the outputted signals, and evoking respective hearing percepts based on the processed outputted signals over a temporal period substantially corresponding to the outputs of the first signals and the second signals, wherein the processing of the second signals is executed in a different manner from that of the first signals.

In accordance with another exemplary embodiment, there is a device, comprising a hearing prosthesis including a transducer sub-system configured to transduce energy originating from an acoustic signal and from body noise, and further including a control unit configured to identify the presence of an own voice body conducted noise event based on the transduced energy, wherein the hearing prosthesis is configured to cancel body conducted noise energy from a transducer signal including energy originating from the acoustic signal at least in the absence of an identification of the presence of the own voice body conducted noise event.

In accordance with another embodiment, there is a device, comprising a hearing prosthesis including a transducer sub-system configured to transduce energy originating from an acoustic signal and from body conducted noise, and output a signal based on the acoustic signal and on the body conducted noise, wherein the hearing prosthesis is configured to determine that at least one of own voice content is present or own voice content is absent in the output, evoke a hearing percept having a significant body conducted noise content upon at least one of the determination that own voice content is present in the output or failure to determine that own voice content is absent from the output, and evoke a hearing percept having substantially no body conducted noise content upon at least one of a determination that own voice content is absent from the output or upon failure to determine that own voice content is present in the output.

In accordance with another embodiment, there is a device comprising an apparatus configured to receive signals indicative of transduced energy originating from body conducted noise, and alter a functionality of the hearing prosthesis upon a determination that at least one of a type of body conducted noise is present or a change in the type of body conducted noise has occurred based on data based on the received signals. In an exemplary embodiment of this device, the apparatus is configured to generate the data based on an internal performance of a noise cancellation system that utilizes the signals indicative of the transduced energy originating from the body conducted noise. In another exemplary embodiment of this device, the device is configured to evaluate the signals and generate the data based on the evaluation of the signals.

In accordance with another embodiment, there is a device comprising an apparatus configured to receive signals indicative of transduced energy originating from body conducted noise, evaluate the received signals and determine that the received signals are indicative of a first type of body conducted noise as differentiated from a second type of body conducted noise. In an exemplary embodiment of this device, the first type of body conducted noise is own voice body conducted noise, and the second type of body noise is non-own voice body conducted noise. In another exemplary embodiment of this device, the devices is configured to transduced energy originating from ambient sound and evoke a hearing percept based thereon, and the device is configured to automatically change operation from a first manner to a second manner if a determination has been made that the received signals are indicative of the first type of body conducted noise. In another exemplary embodiment of this device, the devices configured to transduce energy originating from ambient sound and evoke a hearing percept based thereon, wherein the evoked hearing percept is evoked in a first manner if a determination has been made that the received signals are indicative of the first type of body noise, and evoke the hearing percept in a second manner if a determination has been made that the received signals are indicative of the second type of body conducted noise.

BRIEF DESCRIPTION OF THE DRAWINGS

Embodiments of the present invention are described below with reference to the attached drawings, in which.

DETAILED DESCRIPTION

Figure 1:
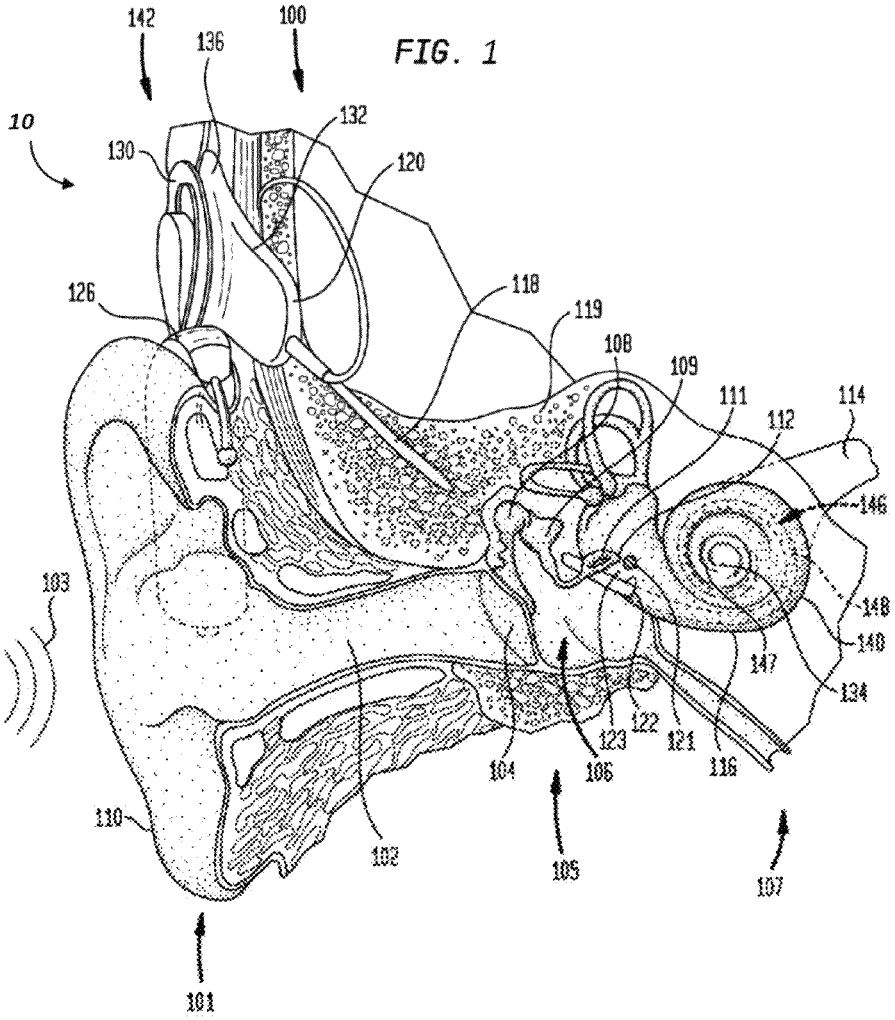
FIG. 1 is a perspective view of an exemplary hearing prosthesis in which at least some of the teachings detailed herein are applicable.

FIG. 1 is perspective view of a totally implantable cochlear implant, referred to as cochlear implant 100, implanted in a recipient, to which some embodiments detailed herein and/or variations thereof are applicable. The totally implantable cochlear implant 100 is part of a system 10 that can include external components, in some embodiments, as will be detailed below. It is noted that the teachings detailed herein are applicable, in at least some embodiments, to any type of hearing prosthesis having an implantable microphone.

It is noted that in alternate embodiments, the teachings detailed herein and/or variations thereof can be applicable to other types of hearing prostheses, such as, for example, bone conduction devices (e.g., active transcutaneous bone conduction devices), Direct Acoustic Cochlear Implant (DACI) etc. Embodiments can include any type of hearing prosthesis that can utilize the teachings detailed herein and are variations thereof. It is further noted that in some embodiments, the teachings detailed herein and are variations thereof can be utilized other types of prostheses beyond hearing prostheses.

The recipient has an outer ear 101, a middle ear 105 and an inner ear 107. Components of outer ear 101, middle ear 105 and inner ear 107 are described below, followed by a description of cochlear implant 100.

In a fully functional ear, outer ear 101 comprises an auricle 110 and an ear canal 102. An acoustic pressure or sound wave 103 is collected by auricle 110 and channeled into and through ear canal 102. Disposed across the distal end of ear channel 102 is a tympanic membrane 104 which vibrates in response to sound wave 103. This vibration is coupled to oval window or fenestra ovalis 112 through three bones of middle ear 105, collectively referred to as the ossicles 106 and comprising the malleus 108, the incus 109 and the stapes 111. Bones 108, 109 and 111 of middle ear 105 serve to filter and amplify sound wave 103, causing oval window 112 to articulate, or vibrate in response to vibration of tympanic membrane 104. This vibration sets up waves of fluid motion of the perilymph within cochlea 140. Such fluid motion, in turn, activates tiny hair cells (not shown) inside of cochlea 140. Activation of the hair cells causes appropriate nerve impulses to be generated and transferred through the spiral ganglion cells (not shown) and auditory nerve 114 to the brain (also not shown) where they are perceived as sound.

As shown, cochlear implant 100 comprises one or more components which are temporarily or permanently implanted in the recipient. Cochlear implant 100 is shown in FIG. 1 with an external device 142, that is part of system 10 (along with cochlear implant 100), which, as described below, is configured to provide power to the cochlear implant, where the implanted cochlear implant includes a battery that is recharged by the power provided from the external device 142. In the illustrative arrangement of FIG. 1, external device 142 can comprise a power source (not shown) disposed in a Behind-The-Ear (BTE) unit 126. External device 142 also includes components of a transcutaneous energy transfer link, referred to as an external energy transfer assembly. The transcutaneous energy transfer link is used to transfer power and/or data to cochlear implant 100. Various types of energy transfer, such as infrared (IR), electromagnetic, capacitive and inductive transfer, may be used to transfer the power and/or data from external device 142 to cochlear implant 100. In the illustrative embodiments of FIG. 1, the external energy transfer assembly comprises an external coil 130 that forms part of an inductive radio frequency (RF) communication link. External coil 130 is typically a wire antenna coil comprised of multiple turns of electrically insulated single-strand or multi-strand platinum or gold wire. External device 142 also includes a magnet (not shown) positioned within the turns of wire of external coil 130. It should be appreciated that the external device shown in FIG. 1 is merely illustrative, and other external devices may be used with embodiments of the present invention.

Cochlear implant 100 comprises an internal energy transfer assembly 132 which can be positioned in a recess of the temporal bone adjacent auricle 110 of the recipient. As detailed below, internal energy transfer assembly 132 is a component of the transcutaneous energy transfer link and receives power and/or data from external device 142. In the illustrative embodiment, the energy transfer link comprises an inductive RF link, and internal energy transfer assembly 132 comprises a primary internal coil 136. Internal coil 136 is typically a wire antenna coil comprised of multiple turns of electrically insulated single-strand or multi-strand platinum or gold wire.

Cochlear implant 100 further comprises a main implantable component 120 and an elongate electrode assembly 118. In some embodiments, internal energy transfer assembly 132 and main implantable component 120 are hermetically sealed within a biocompatible housing. In some embodiments, main implantable component 120 includes an implantable microphone assembly (not shown) and a sound processing unit (not shown) to convert the sound signals received by the implantable microphone in internal energy transfer assembly 132 to data signals. That said, in some alternative embodiments, the implantable microphone assembly can be located in a separate implantable component (e.g., that has its own housing assembly, etc.) that is in signal communication with the main implantable component 120 (e.g., via leads or the like between the separate implantable component and the main implantable component 120). In at least some embodiments, the teachings detailed herein and are variations thereof can be utilized with any type of implantable microphone arrangement. Some additional details associated with the implantable microphone assembly 137 will be detailed below.

Main implantable component 120 further includes a stimulator unit (also not shown) which generates electrical stimulation signals based on the data signals. The electrical stimulation signals are delivered to the recipient via elongate electrode assembly 118.

Elongate electrode assembly 118 has a proximal end connected to main implantable component 120, and a distal end implanted in cochlea 140. Electrode assembly 118 extends from main implantable component 120 to cochlea 140 through mastoid bone 119. In some embodiments electrode assembly 118 may be implanted at least in basal region 116, and sometimes further. For example, electrode assembly 118 may extend towards apical end of cochlea 140, referred to as cochlea apex 134. In certain circumstances, electrode assembly 118 may be inserted into cochlea 140 via a cochleostomy 122. In other circumstances, a cochleostomy may be formed through round window 121, oval window 112, the promontory 123 or through an apical turn 147 of cochlea 140.

Electrode assembly 118 comprises a longitudinally aligned and distally extending array 146 of electrodes 148, disposed along a length thereof. As noted, a stimulator unit generates stimulation signals which are applied by electrodes 148 to cochlea 140, thereby stimulating auditory nerve 114.

As noted, cochlear implant 100 comprises a totally implantable prosthesis that is capable of operating, at least for a period of time, without the need for external device 142. Therefore, cochlear implant 100 further comprises a rechargeable power source (not shown) that stores power received from external device 142. The power source can comprise, for example, a rechargeable battery. During operation of cochlear implant 100, the power stored by the power source is distributed to the various other implanted components as needed. The power source may be located in main implantable component 120, or disposed in a separate implanted location.

It is noted that the teachings detailed herein and/or variations thereof can be utilized with a non-totally implantable prosthesis. That is, in an alternate embodiment of the cochlear implant 100, the cochlear implant 100 is traditional hearing prosthesis.

In some exemplary embodiments, a signal sent to the stimulator of the cochlear implant can be derived from an external microphone, in which case the system is called a semi-implantable device, or from an implanted microphone, which then refers to a fully implantable device. DACIs can also use an implanted microphone, and thus are also fully implantable devices. Fully implantable devices can have utility by presenting improved cosmesis, can have a improved immunity to certain noises (e.g., wind noise), can present few opportunities for loss or damage, and can at least sometimes be more resistant to clogging by debris or water, etc. DACIs can have utilitarian value by keeping the ear canal open, which can reduce the possibility of infection of the ear canal, which otherwise is humid, often impacted with cerumen (earwax), and irritated by the required tight fit of a non-implanted hearing aid.

Implanted microphones can detect pressure. In at least some embodiments, they are configured to detect air pressure which is subsequently transmitted through the tissue to the microphone. Implanted microphones can detect other pressures presented to their surface, which can be undesirable in certain circumstances. One type of pressure which can represent an impairment to the performance of an implanted microphone is pressure due to acceleration. In some embodiments, such acceleration can have a deleterious effect on a hearing prosthesis if it is in the desired operational frequency range of the prosthesis, typically 20 Hz to 20 kHz, although narrower ranges still give satisfactory speech intelligibility. Accelerations may arise from, for example, foot impact during walking, motion of soft tissue relative harder tissues, wear of harder tissues against each other, chewing, and vocalization. In the case of a DACI, the acceleration can be caused by the actuator driving the ossicles.

In some embodiments, the accelerations induce pressure on the microphone, which cannot distinguish the desired pressure due to external sounds from the largely undesired pressure due to internal vibration originating directly from the body, or borne to the microphone through the body from an implanted actuator. The accelerations can be thought of as giving rise to these pressures by virtue of the microphone being driven into the tissue. If the microphone is securely mounted on the skull, and the skull vibrates normal to its surface, the microphone diaphragm will be driven into the tissue which, due to the mass, and hence inertia of the tissue, can present a reactive force to the microphone. That reactive force divided by the area of the microphone is the pressure generated by acceleration. The formula for acceleration pressure can be:

$$\Delta P = \rho \cdot t \cdot \alpha$$

where $\Delta P$ is the instantaneous pressure above $P_0$, the ambient pressure, $\rho$ is the mean density of tissue over the microphone, t is the mean thickness of tissue over the microphone, and $\alpha$ is the instantaneous acceleration. When the acceleration is normal but into the surface rather than away from the surface, a decrease in pressure is generated rather than an increase.

In some instances, there can be utilitarian value to reducing signal outputs due to acceleration. Because the relative body-borne to air-borne pressure of an implanted microphone is typically 10-20 dB higher than that that occurs in normal hearing, body originating sounds can be louder relative to externally originating sound. Such large ratios of vibration to acoustic signals are experienced by a recipient as banging and crashing during movement, very noisy chewing, and their own voice being abnormally loud relative to other speakers. At the same time, it should be noted that there is utilitarian value in avoiding the cancellation of all or part of the recipient's own voice. Complete cancellation of the recipient's own voice can result in, in some embodiments, the recipient speaking very loudly compared to other speakers. It is therefore utilitarian to reduce the ratio of vibration to acoustic signals to a level, such as a comparable level, to that found in normal hearing. In some embodiments, this can be achieved by an effective reduction of the acceleration pressure/air-borne pressure sensitivity of 10-20 dB. By doing so, a ratio of acoustic signal to vibration signal similar to what is experienced in normal hearing, and hence a more natural listening experience, can be achieved.

Additionally, signal borne by the body from an actuator as in a DACI can be amplified by the signal processing of the implant, and can present a gain of greater than 1 at some frequency around the loop formed by the microphone, signal processing, actuator, and tissue. This is can be the case when dealing with high gains such as may be the case with moderate to large hearing loss. Under such circumstances, unless additional steps are taken such as are disclosed herein, the hearing prosthetic system can undergo positive feedback at some frequency and begin "singing," or oscillating. This oscillation can reduce the speech intelligibility, effectively masking out at least the frequency at which oscillation is occurring at, and often other frequencies through a psychoacoustic phenomenon called spread of masking. It can be annoying for the recipient, because the oscillation can occur at a very loud level, and increases the load on the battery, shortening required time between changing or charging batteries. This can require a much greater reduction in feedback of 25-55 dB (often 35-45 dB), and can depend upon the hearing loss of the recipient, as the more hearing loss of the recipient, the more gain will need to be given in the signal processing, at least in some instances. It can therefore be seen that a fully implantable DACI can need more attenuation to reduce (including eliminate) feedback to balance air to bone conducted sound level differences such as might be needed in a fully implantable cochlear implant.

An exemplary embodiment that includes an implantable microphone assembly utilizes a motion sensor to reduce the effects of noise, including mechanical feedback and biological noise, in an output response of the implantable microphone assembly. In an exemplary embodiment, the diaphragm of the implantable microphone assembly that vibrates as a result of waves traveling through the skin of the recipient originating from an ambient sound, can be also affected by body noise and the like. To actively address non-ambient noise sources (e.g., body noise conducted through tissue of a recipient to a microphone, which in at least some embodiments is not of an energy lever and/or frequency to be audible at a location away from the recipient, at least not without sound enhancement devices) of vibration of the diaphragm of the implantable microphone and thus the resulting undesired movement between the diaphragm and overlying tissue, some embodiments utilize a motion sensor to provide an output response proportional to the vibrational movement experienced by the microphone assembly. Generally, the motion sensor can be mounted anywhere such that it enables the provision of a sufficiently accurate representation of the vibration received by the implantable microphone in general, and the diaphragm of the implantable microphone, in particular. The motion sensor can be part of the assembly that contains the microphone/diaphragm thereof, while in an alternate embodiment it can be located in a separate assembly (e.g. a separate housing etc.). In an exemplary embodiment, the motion sensor is substantially isolated from the receipt of the ambient acoustic signals originating from an ambient sound that pass transcutaneously through the tissue over the microphone/diaphragm of the microphone and which are received by the microphone diaphragm. In this regard, the motion sensor can provide an output response/signal that is indicative of motion (e.g., caused by vibration and/or acceleration), whereas a transducer of the microphone can generate an output response/signal that is indicative of both transcutaneously received acoustic sound and motion. Accordingly, the output response of the motion sensor can be removed from the output response of the microphone to reduce the effects of motion on the implanted hearing system.

Figure 2:
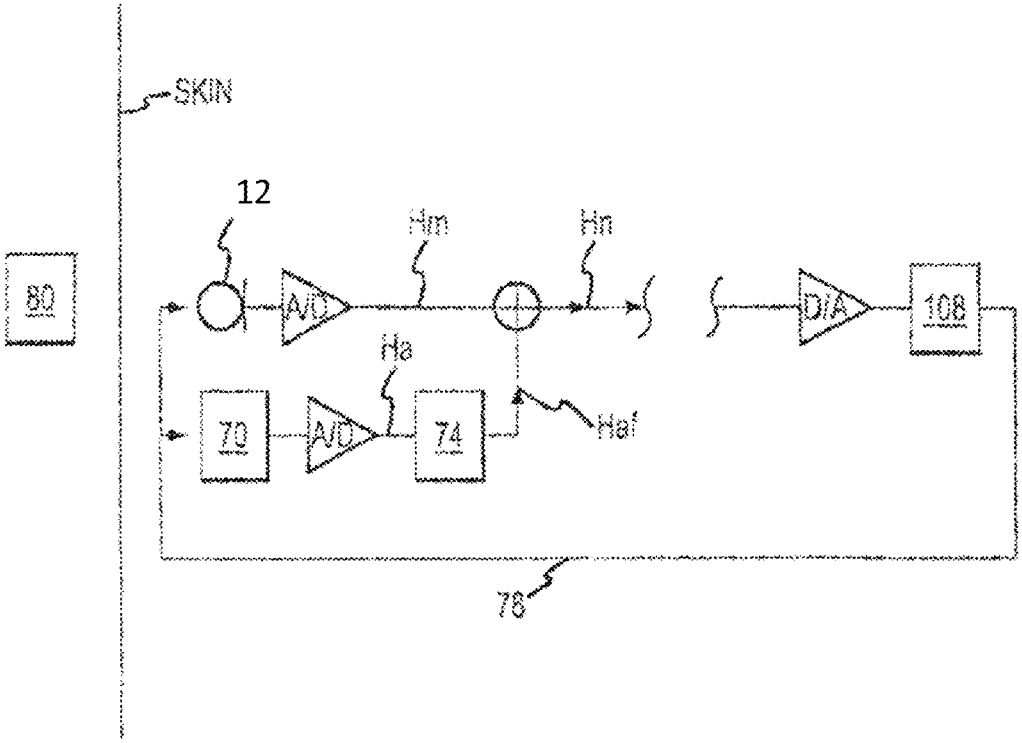
FIG. 2 schematically illustrates an implantable hearing system that incorporates an implantable microphone assembly and motion sensor 70.

Accordingly, to remove noise, including feedback and biological noise, it is utilitarian to measure the acceleration of the microphone assembly. FIG. 2 schematically illustrates an implantable hearing system that incorporates an implantable microphone assembly having a microphone 12 including a diaphragm and motion sensor 70. As shown, the motion sensor 70 further includes a filter 74 that is utilized for matching the output response Ha of the motion sensor 70 to the output response Hm of the microphone 12. Of note, the diaphragm of microphone 12 is subject to desired acoustic signals (i.e., from an ambient source 103), as well as undesired signals from biological sources (e.g., vibration caused by talking, chewing etc.) and, depending on the type of output device 108 (e.g., bone conduction vibratory apparatus, DACI actuator, and, in some instances, cochlear implant electrode array) feedback from the output device 108 received by a tissue feedback loop 78. In contrast, the motion sensor 70 is substantially isolated (which includes totally isolated) from the ambient source and is subjected to only the undesired signals caused by the biological source and/or by feedback received via the feedback loop 78. Accordingly, the output of the motion sensor 70 corresponds the undesired signal components of the microphone 12. However, the magnitude of the output channels (i.e., the output response Hm of the microphone 12 and output response Ha of the motion sensor 70) can be different and/or shifted in phase. In order to remove the undesired signal components from the microphone output response Hm, the filter 74 and/or the system processor can be operative to filter one or both of the responses to provide scaling, phase shifting and/or frequency shaping. The output responses Hm and Ha of the microphone 12 and motion sensor 70 are then combined by summation unit 76, which generates a net output response Hn that has a reduced response to the undesired signals.

In order to implement a filter 74 for scaling and/or phase shifting the output response Ha of a motion sensor 70 to remove the effects of feedback and/or biological noise from a microphone output response Hm, a system model of the relationship between the output responses of the microphone 12 and motion sensor 70 is identified/developed. That is, the filter 74 can be operative to manipulate the output response Ha of the motion sensor 70 to biological noise and/or feedback, to replicate the output response Hm of the microphone 12 to the same biological noise and/or feedback. In this regard, the filtered output response Haf and Hm may be of substantially the same magnitude and phase prior to combination (e.g., subtraction/cancellation). However, it will be noted that such a filter 74 need not manipulate the output response Ha of the motion sensor 70 to match the microphone output response Hm for all operating conditions. Rather, the filter 74 can match the output responses Ha and Hm over a predetermined set of operating conditions including, for example, a desired frequency range (e.g., an acoustic hearing range) and/or one or more pass bands. Note also that the filter 74 can accommodate the ratio of microphone output response Hm to the motion sensor output response Ha to acceleration, and thus any changes of the feedback path which leave the ratio of the responses to acceleration unaltered have little or no impact on good cancellation. Such an arrangement thus can have significantly reduced sensitivity to the posture, clenching of teeth, etc., of the recipient.

Figure 3A:
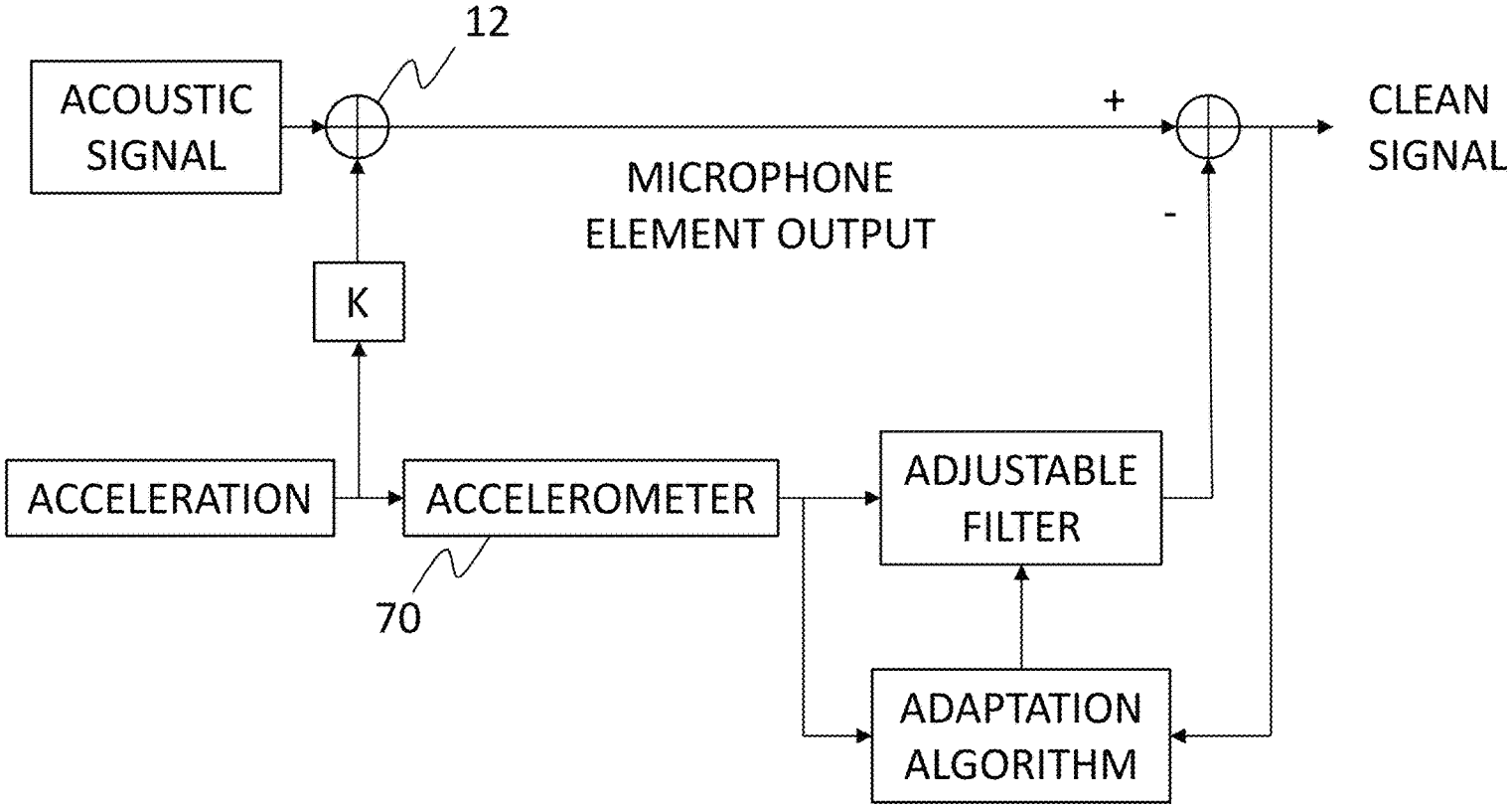
FIG. 3A functionally illustrates an exemplary use of adaptive filters.

An exemplary embodiment utilizes adaptive filter(s) to filter out body noise and the like. More particularly, FIG. 3A functionally illustrates an exemplary use of such adaptive filters. In FIG. 3, biological noise is modeled by the acceleration at the microphone assembly filtered through a linear process K. This signal is added to the acoustic signal at the surface of the microphone element. In this regard, the microphone 12 sums the signals. If the combination of K and the acceleration are known, the combination of the accelerometer output and the adaptive/adjustable filter can be adjusted to be K. This is then subtracted out of the microphone output at point. This will result in the cleansed or net audio signal with a reduced biological noise component. This net signal may then be passed to the signal processor where it can be processed by the hearing system.

Figure 3B:
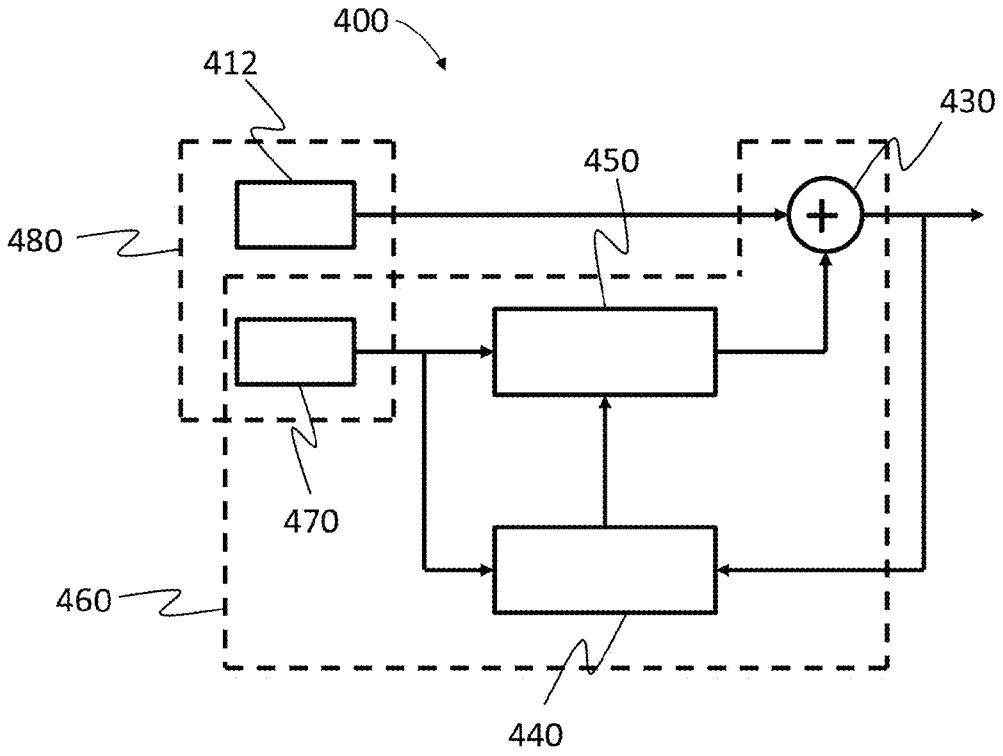
FIG. 3B functionally depicts an exemplary embodiment of a system that is usable in the hearing prosthesis of FIG. 1 that functionally operates in accordance with the schematic of FIG. 3A.

FIG. 3B functionally depicts an exemplary embodiment of a system 400 that is usable in the hearing prosthesis 10 of FIG. 1 that functionally operates in accordance with the schematic of FIG. 3A. As can be seen, the system 400 includes microphone 412 and accelerometer 470. The microphone 412 is configured such that it receives signals resulting from the ambient sound, as well as biological noise/body noise, including, in at least some embodiments, signals resulting from a recipient's own voice that travels through the body via bone conduction/tissue conduction. These latter signals are added at the microphone 412 to the signals resulting from ambient sound because the microphone 412 detects both signals. Conversely, accelerometer 470 is functionally isolated from the signals resulting from the ambient sound, and generally only responds to body noise signals and/or feedback signals. The system 400 incorporates an adjustable filter apparatus 450 controlled by a control unit 440 that runs an adaptive algorithm to control the filter(s) of the adjustable filter apparatus 450. Details of the adaptive algorithm are provided below, but briefly, as can be seen, the output of the adaptive filter apparatus 450, controlled by filter control unit 440, is fed to adder 430, wherein it is added to (or, more accurately, subtracted from) the output of the microphone 412, and passed on to a signal processor and/or an output device (not shown, but, for example, a receiver stimulator of a cochlear implant, an actuator of a DACI, and/or an actuator (vibrator) of an active transcutaneous bone conduction device) of the hearing prosthesis system 400. Collectively, the accelerometer 470, the adjustable filters 450, the filter control unit 440, and the adder 430 corresponds to an adaptive noise cancellation sub-system 460.

Adaptive filters can perform this process using the ambient signals of the acceleration and the acoustic signal plus the filtered acceleration. The adaptive algorithm and adjustable filter can take on many forms, such as continuous, discrete, finite impulse response (FIR), infinite impulse response (IIR), lattice, systolic arrays, etc. Some exemplary algorithms for the adaptation algorithm include stochastic gradient-based algorithms such as the least-mean-squares (LMS) and recursive algorithms such as RLS. Alternatively and/or in addition to this, algorithms which are numerically more stable can be utilized in some alternate embodiments, such as the QR decomposition with RLS (QRD-RLS), and fast implementations somewhat analogous to the FFT. The adaptive filter can incorporate an observer, that is, a module to determine one or more intended states of the microphone/motion sensor system. The observer can use one or more observed state(s)/variable(s) to determine proper or utilitarian filter coefficients. Converting the observations of the observer to filter coefficients can be performed by a function, look up table, etc. In some exemplary embodiments, adaptation algorithms can be written to operate largely in the digital signal processor "background," freeing needed resources for real-time signal processing.

Figure 4:
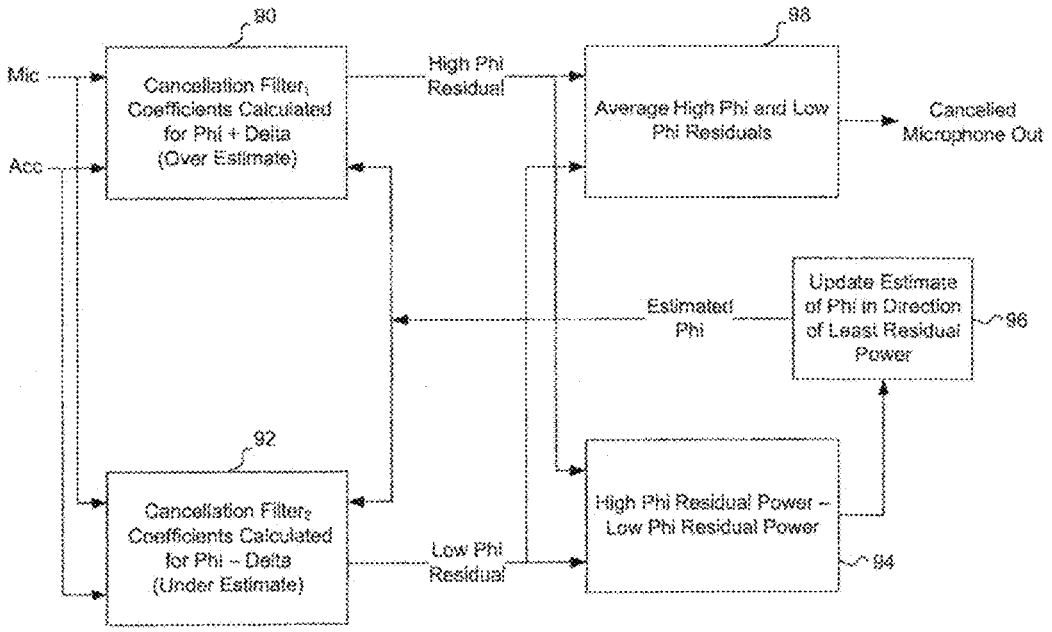
FIG. 4 is a schematic illustration of an embodiment of an implantable hearing prosthesis that utilizes a plurality of cancellation filters.

FIG. 4 presents a functional diagram of an exemplary adaptive filter arrangement that utilizes an adaptive filter that adapts based on current operating conditions (e.g., operating environment) of the implantable hearing prosthesis. It is noted that the teachings detailed herein and/or variations thereof can be combined with some or all of the teachings of U.S. Patent Application Publication No. 2012/0232333, published on Sep. 13, 2012, to Inventor Scott Allan Miller, a co-inventor of this application. In this regard, at least some embodiments include devices, systems and/or methods that utilize one or more or all of the teachings of U.S. Patent Application Publication No. 2012/0232333 in combination with one or more or all of the teachings detailed herein.

There are some scenarios where such operating conditions are often not directly observable/are not directly observed even though they might be able to be directly observed utilizing certain components that might not be present in the hearing prostheses. That is, the operating conditions form a latent parameter. Accordingly, the system is operative to estimate this latent parameter for purposes of adapting to current operating conditions. Stated otherwise, the system utilizes a latent variable adaptive filter.

In an exemplary embodiment, the latent variable adaptive filter (LVAF) is computationally efficient, converges quickly, can be easily stabilized, and its performance is robust in the presence of correlated noise. It can be based on IIR filters, but rather than adapting all the coefficients independently, it can utilize the functional dependence of the coefficients on a latent variable. In statistics, a latent variable is one which is not directly observable, but that can be deduced from observations of the system. An example of a latent variable is the thickness of the tissue over the microphone and/or wave propagation properties through the tissue over the microphone. In at least some exemplary embodiments, this is not directly measured, but instead is deduced from the change in the microphone motion sensor (i.e., mic/acc) transfer function. Another hidden variable may be user "posture." It has been noted that some users of implantable hearing instruments experience difficulties with feedback when turning to the left or the right (usually one direction is worse) if the (nonadaptive) cancellation filter has been optimized with the recipient facing forward. Posture could be supposed to have one value at one "extreme" position, and another value at a different "extreme" position. "Extreme," in this case, is flexible in meaning; it could mean at the extreme ranges of the posture, or it could mean a much more modest change in posture that still produces different amounts of feedback for the recipient. Posture in this case can be a synthetic hidden variable (SHV), in that the actual value of the variable is arbitrary; what is important is that the value of the hidden variable changes with the different measurements. For instance, the value of the SHV for posture could be "+90" for the recipient facing all the way to the right, and "−90" for a recipient facing all the way to the left, regardless of whether the recipient actually rotated a full 90 degrees from front. The actual value of the SHV is arbitrary, and could be "−1" and "+1," or "0" and "+1" if such ranges lead to computational simplification.

It is noted that while the teachings detailed herein relating to the parameters are described in terms of the embodiments where the parameters are posture parameters, the parameters can be other parameters. Indeed, in an exemplary embodiment, the noise cancellation sub-systems detailed herein and/or variations thereof can track any impairment of the system, at least as long as the presence of the impairment can be detected. For example, an impairment could arise from for example an overflow of an internal register which, in some instances can cause oscillations in the outputs.

In the case of posture, in an exemplary embodiment, a physical parameter(s) are assigned to the SHV, such as the angle that the recipient is turned from facing forward. However, there are other cases in which the variable is truly hidden. An example might be where the recipient activates muscle groups internally, which may or may not have any external expression. In this case, if the tonus and non-tonus conditions affect the feedback differently, the two conditions could be given values of "0" and "+1," or some other arbitrary values. One of the advantages of using SHVs is that only the measurements of the vibration/motion response of the microphone assembly need to be made, it may be utilitarian not to measure the actual hidden variable. That is, the hidden variable(s) can be estimated and/or deduced.

As shown in FIG. 4, the adaptive system can utilize two adaptive cancellation filters 90 and 92 instead of one fixed cancellation filter. The cancellation filters are identical and each cancellation filter 90, 92, can include an adaptive filter (not shown) for use in adjusting the motion accelerometer signal, Acc, to match the microphone output signal, Mic, and thereby generate an adjusted or filtered motion signal. Additionally, each cancellation filter can include a summation device (not shown) for use in subtracting the filtered motion signals from the microphone output signals and thereby generate cancelled signals that are an estimate of the microphone response to desired signals (e.g., ambient acoustic signals). Each adaptive cancellation filter 90, 92 estimates a latent variable 'phi', a vector variable which represents the one or more dimensions of posture or other variable operating conditions that change in the recipient, but whose value is not directly observable. The estimate of the latent variable phi is used to set the coefficients of the cancellation filters to cancel out microphone noise caused by, for example, feedback and biological noise. That is, all coefficients of the filters 90, 92 are dependent upon the latent variable phi. After cancellation, one, both or a combination of the cancelled microphone signals, essentially the acoustic signal, are passed onto the remainder of the hearing instrument for signal processing.

In order to determine the value of the latent variable phi that provides the best cancellation, the coefficients of the first cancellation filter 90 are set to values based on an estimate of the latent variable phi. In contrast, the coefficients of the second cancellation filter 92, called the scout cancellation filter 92, are set to values based on the estimate of the latent variable phi plus (or minus) a predetermined value delta. Alternatively, the coefficients of the first filter 90 may be set to values of the latent variable plus delta and the coefficients of the second filter may be set to values of the latent variable minus delta. In this regard, the coefficients of the second adaptive filter 92 are slightly different than the coefficients of the first filter 90. Accordingly, the energies of the first and second cancelled signals or residuals output by the first and second adaptive cancellation filters 90, 92 may be slightly different. The residuals, which are the uncancelled portion of the microphone signal out of each cancellation filter 90, 92, are compared in a comparison module 94, and the difference in the residuals are used by the Phi estimator 96 to update the estimate of phi. Accordingly, the process may be repeated until the value of phi is iteratively determined. In this regard, phi may be updated until the residual value of the first and second cancellation filters is substantially equal. At such time, either of the cancelled signals may be utilized for subsequent processing, or, the cancelled signals may be averaged together in a summation device 98 and then processed.

Adjustment of the latent variable phi based on the comparison of the residuals of the cancelled signals allows for quickly adjusting the cancellation filters to the current operating conditions of the implantable hearing instrument. To further speed this process, it may be utilitarian to make large adjustments (i.e., steps) of the latent value, phi. For instance, if the range of the phi is known (e.g., 0 to 1) an initial mid-range estimate of phi (e.g., ½) may be utilized as a first estimate. Alternatively, the initial values of phi can be set at 0 (which can correspond to a relaxed posture, with respect to embodiments where phi is related to posture), and iteration proceeds from those values.

Likewise, the step size of the adjustment of phi may be relatively large (e.g., 0.05 or 0.1) to allow for quick convergence of the filter coefficients to adequately remove noise from the microphone output signal in response to changes in the operating conditions.

In order to implement the system of FIG. 4, in at least some embodiments, a filter is generated where the filter coefficients are dependent upon a latent variable that is associated with variable operating conditions/environment of the implantable hearing instrument. FIGS. 5-8 provide a broad overview of how dependency of the adaptive filter on varying operating conditions can be established in at least some embodiments.

Figure 5:
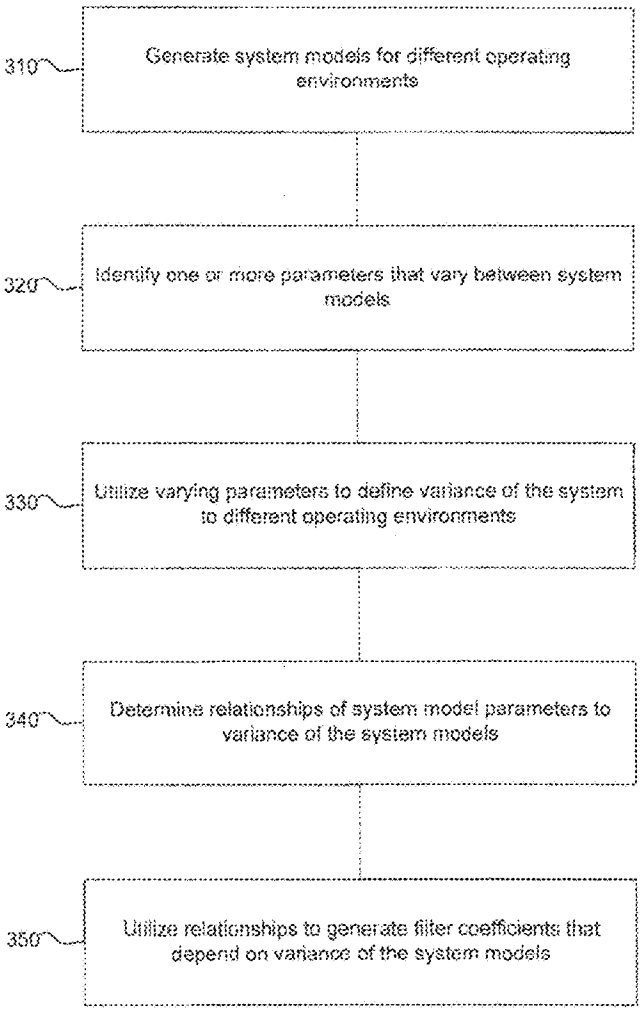
FIG. 5 depicts an exemplary flow chart according to an exemplary process.

FIG. 5 illustrates an overall process for generating the filter. Initially, the process requires two or more system models be generated for different operating environments. For instance, system models can be generated while a recipient is looking to the left, straight ahead, to the right and/or tilted. The system models may be generated as discussed above and/or as discussed in U.S. Patent Application Publication No. 20120232333 and/or according to any utilitarian methodology. Once such system models are generated at action 310, parameters of each of the system models may be identified at action 320. Specifically, parameters that vary between the different system models and hence different operating environments can be identified at action 320.

Figure 6:
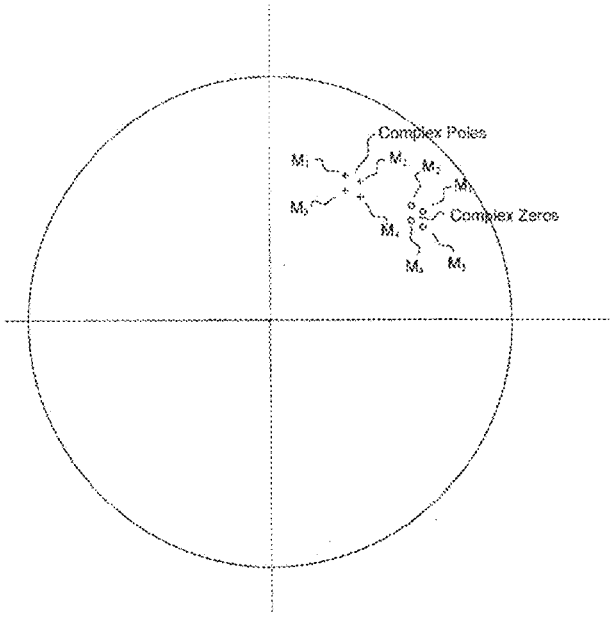
FIG. 6 depicts a plot of operating parameters in a unit circle.
Figure 7:
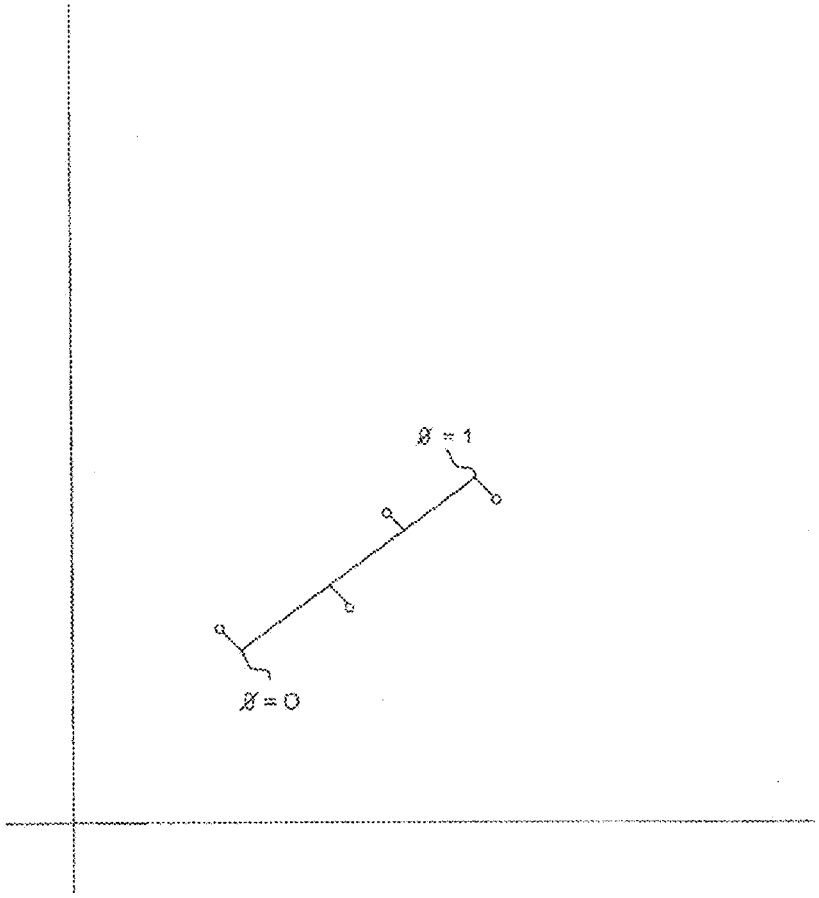
FIG. 7 illustrates the fitting of a line to a first set of operating parameters to define a range of a latent variable.

For instance, each system model can include multiple dimensions. Such dimensions may include, without limitation, gain, a real pole, a real zero, as well as complex poles and zeros. Further, it will be appreciated that complex poles and zeros may include a radius as well as an angular dimension. In any case, a set of these parameters that vary between different models (i.e., and different operating environments) may be identified. For instance, it may be determined that the complex radius and complex angle and gain (i.e., three parameters) of each system model show variation for different operating conditions. For instance, FIG. 6 illustrates a plot of a unit circle in a "z" dimension. As shown, the complex zeros and complex poles for four system models $M_1$ to $M_4$ are projected onto the plot. As can be seen, there is some variance between the parameters of the different system models. However, it will be appreciated that other parameters can be selected. In at least some embodiments, the parameters that are selected are selected such that they vary between the system models and this variance is caused by change in the operating condition of the implantable hearing instrument.

Figure 8:
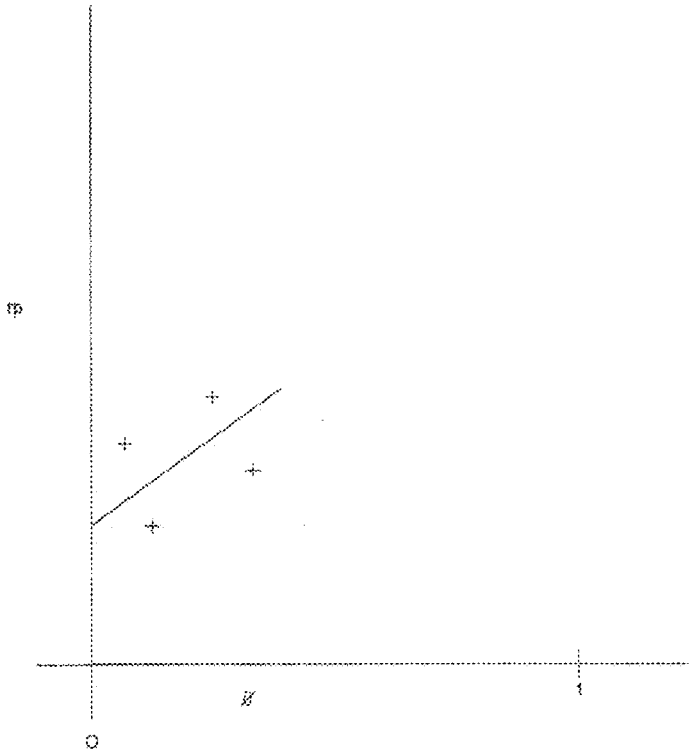
FIG. 8 illustrates a linear regression analysis of system parameters to the latent variable.

Once the variable parameters are identified at action 320, they can be projected onto a subspace (action 330). In the present arrangement, where multiple parameters are selected, this can entail executing a principle component analysis on the selected parameters in order to reduce their dimensionality. Specifically, in the present embodiment, principle component analysis is performed to reduce dimensionality to a single dimension such that a line can be fit to the resulting data points. (See, for example, FIG. 7.) Accordingly, this data can represent operating environment variance or latent variable for the system. For instance, in the present arrangement where four system models are based on four different postures of the user, the variance can represent a posture value. Further, the plot can define the range of the latent variable. That is, a line fit to the data may define the limits of the latent invariable. For instance, a first end of the line may be defined as zero, and the second end of the line may be defined as one. At this point, a latent variable value for each system model may be identified. Further, the relationship of the remaining parameters of each of the system models can be determined relative to the latent variables of the system models (e.g., action 340). For instance, as shown in FIG. 8, a linear regression analysis of all the real poles of the four system models to the latent variable may be projected. In this regard, the relationship of each of the parameters (i.e., real poles, real zeros, etc.) relative to the latent variables may be determined. For instance, a slope of the resulting linear regression may be utilized as a sensitivity for each parameter. Accordingly, this relationship between the parameters and the latent variable are determined, this information may be utilized to generate a coefficient vector, where the coefficient vector may be implemented with the cancellation filters 90, 92 of the system of FIG. 4 (action 350). As will be appreciated, the coefficient vector will be dependent upon the latent variable. Accordingly, by adjusting a single value (the latent variable), all of the coefficients may be adjusted.

It is noted that in some embodiments, a cancellation algorithm according to the teachings above and or variations thereof can be impacted in a deleterious manner by own voice body conducted noise. That is, bone conduction/body conduction sound originating from the recipient's own voice/resulting from the vibrations of the recipient's vocal cords, which hereafter is often simply referred to as "own voice body conducted noise phenomenon," or "own voice phenomenon" for linguistic convenience, and unless otherwise specifically indicated to the contrary, the latter phrase corresponds to noise resulting from a recipient's own voice that is conducted through tissue (e.g., bone) to an implanted microphone. In an exemplary scenario, this is caused by a relatively large amount of acceleration signal which is present in the microphone channel and the accelerometer channel. As a result, the noise cancellation algorithm can, in some instances, respond to own voice signals inappropriately, causing the state variables associated with the parameters (e.g., posture parameters, etc.) to ramp to larger values, eventually hitting the allowed limits of operation. After the own voice phenomenon ceases, the parameters usually return to their appropriate values.

Figure 9:
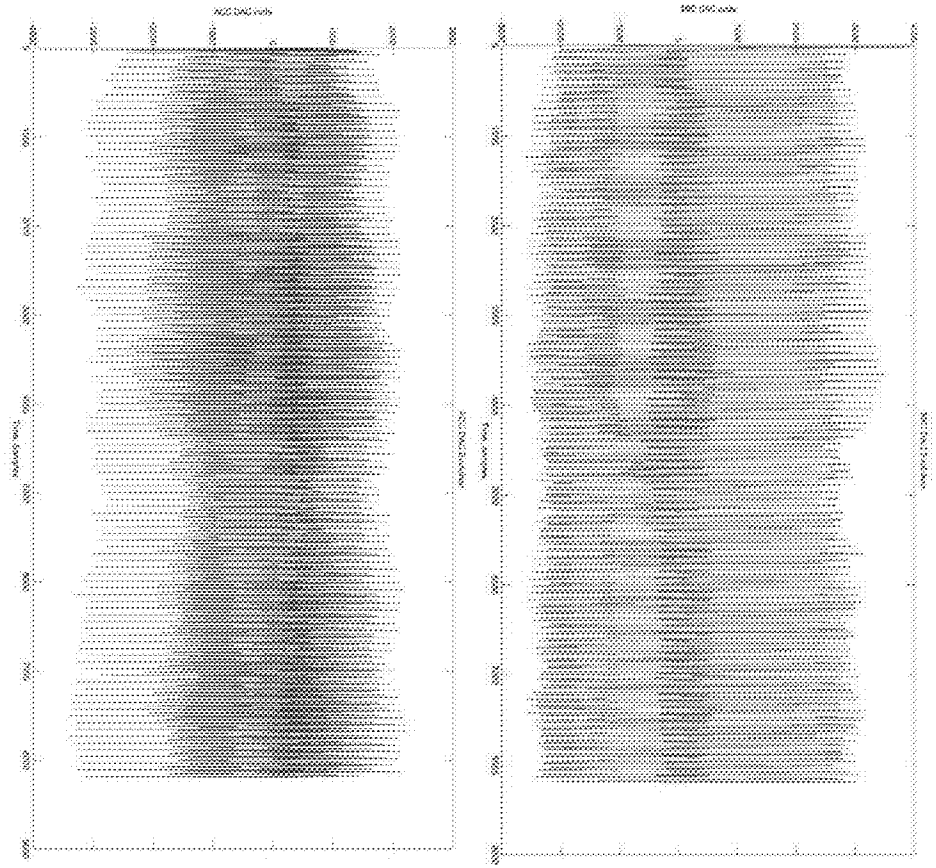
FIG. 9 depicts graphs of microphone ADC output and accelerometer ADC outputs vs. time for a scenario where an own voice body conducted noise phenomenon causes a noise cancellation algorithm to pursue an incorrect set of parameters.

The acceleration transfer function of the accelerometer 470, relative to the acceleration transfer function of the microphone 412, is fixed for a given parameter (e.g., posture parameter). In some scenarios, there can be deviation from the fixed relationship when excited by own voice in some recipients. As a result, the feedback cancellation algorithm pursues an incorrect set of parameters as long as own voice excitation continues. If the deleterious scenario occurs at all, it typically occurs during loud, harmonic phonemes (e.g., vowels), but is distinct from nonlinearity issues such as saturation of the signal chain. More specifically, FIG. 9 depicts graphs of microphone 412 (MIC) ADC output and Accelerometer 470 (ACC) ADC outputs vs. time for a scenario where own voice phenomenon causes the algorithm to pursue an incorrect set of parameters. As can be seen, the MIC and ACC ADC values are not close to saturating levels, which would be about 32,767 to −32,768, and the graphs do not show any of the classic clipping that might be expected.

The following exemplary embodiments are directed towards cancellation algorithms that utilize posture as a parameter.

Figure 10:
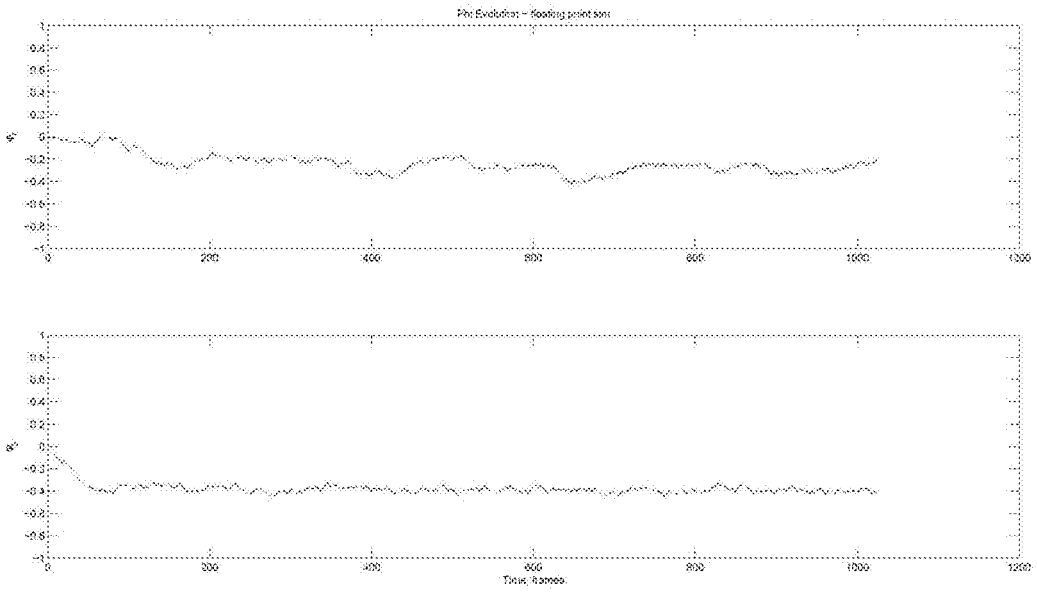
FIG. 10 depicts a graph of phi versus time for a normal evolution of posture variables phi1 and phi2 in a scenario where the effects of own voice body noise do not impact the noise cancellation algorithm.

FIG. 10 depicts graph of phi versus time (in frames of 1 sample per 16 kHz) for a normal evolution of posture variables phi1 and phi2 in the scenario where the effects of own voice body noise do not impact the algorithm, or at least the algorithm is able to cope with the effects of own voice body noise. The limits of phi1 and phi2 are +/−1. As can be seen, the values phi1 and phi2 deviate from the initial value of zero, but generally stay away from the limits (+/−1).

Figure 11:
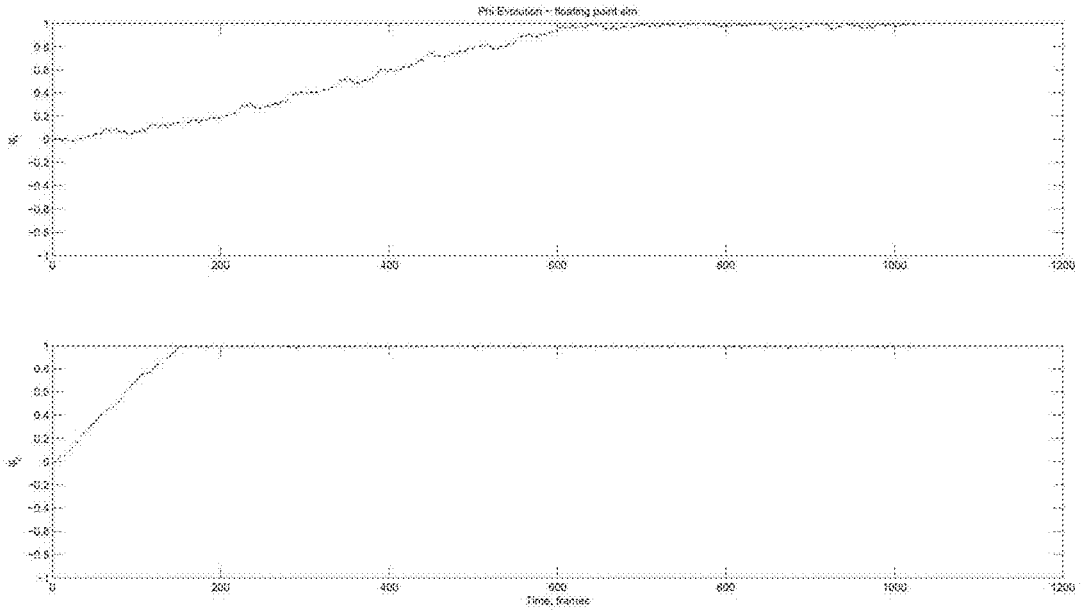
FIG. 11 depicts a graph of phi versus time for a normal evolution of posture variables phi1 and phi2 in a scenario where the effects of own voice body noise impact the noise cancellation algorithm.

FIG. 11 also depicts graph of phi versus time where the effects of own voice body noise impact the algorithm in a manner in which the algorithm is affected in a deleterious manner. More particularly, FIG. 11 depicts a graph where the phoneme "EEEEEE" is intoned in a relatively loud manner by the recipient. As can be seen, the effects of own voice body noise cause the values of phi1 and phi2 to ramp from the initial value of zero to the limit 1, and stay there, or relatively close thereto, for as long as the recipient is vocalizing the aforementioned phoneme.

As noted above, own voice phenomena that results in the values of phi ramping towards the limits can have a deleterious effect on the noise cancellation algorithm. For example, own voice phenomenon prevents the recipient from receiving, in part and/or in whole, the utilitarian effects of feedback cancellation, at least while talking. This can be because the values of phi do not stabilize and, in some instances, can go to the limits. In some instances where real-time values of phi are being utilized for noise cancellation, the ramped up phi values can potentially induce noise into the system. Further, the own voice phenomenon takes time to pull the parameters away from their correct values due to the time constraints in the feedback correction algorithm that is used to improve the resistance the algorithm to noise. Corollary to this is that it can also take time, sometimes about the same amount of time, sometimes more, sometimes less, for the algorithm to recover (e.g. it may take about the same time to roughly retrace the trajectory caused by the own voice phenomenon). For example, with regard to FIG. 11, the time for ramping up is about 37.5 ms, and the time to recover would also be about 37.5 ms. This can correspond to about 75 ms where the full utilitarian effects of feedback cancellation are not available to the recipient.

According to an exemplary embodiment, there is a system that at least partially addresses own noise phenomenon. With reference to FIG. 3B, as noted above, hearing prosthesis system 400 includes an adaptive noise cancellation sub-system 460. The sub-system 460 includes a signal filter sub-system, corresponding to the adjustable filter(s) 450 and/or any other filter apparatus that can enable the teachings detailed herein and or variations thereof to be practiced. As noted above, system 400 in general, and the filter control unit 440 in particular (or, in an alternate embodiment, a separate control unit separate from filter control unit 440), is configured to control the filter coefficient(s) of the signal filter system to affect noise cancellation/noise reduction, including cancelling/reducing body noise.

In an exemplary embodiment, with reference to FIG. 3B, the system 400 in general, and filter control unit 440 in particular (or, in an alternate embodiment a separate control unit), is configured to adjust operation of the sub-system 460 from a first operating state to a second operating state upon a determination that operation of the adaptive noise cancellation sub-system 460 will be affected by an own voice body noise phenomenon. In an exemplary embodiment, this can amount to a determination that there exists own voice body noise content in the signal from the microphone 412 and/or the accelerometer 470. In an exemplary embodiment, sub-system 460 is affected when the own voice body conduction phenomenon results in the calculated/estimated values of phi in the algorithm of the adaptive noise cancellation sub-system ramping towards and/or to the limits, or at least not converging within a predetermined time period, etc. Some exemplary effects/results of operating in these operating states will be described below, but first, a general overview of the operating states will be described.

In an exemplary embodiment, the aforementioned first operating state can be a normal operating state of the sub-system. It can be a state in which the sub-system operates in an absence of a determination that operation of the adaptive noise cancellation sub-system 460 will be affected by an own voice body conduction phenomenon. In an exemplary embodiment, this is a default state of operation. In an exemplary embodiment, only upon the aforementioned determination does the system adjust the operation of the sub-system to the second state.

In at least some exemplary embodiments, the first operating state is a state in which the system operates while the recipient of the system is not speaking or otherwise vocalizing (i.e., making a sound created by the vocal cords). In an exemplary scenario of this embodiment, there is no own voice phenomenon to affect the adaptive noise cancellation sub-system. In a variation of this embodiment, the first operating state is a state in which the system operates while the recipient of the system is speaking or otherwise vocalizing, but the speech/vocalization does not result in the aforementioned deleterious results and/or does not result in an undesirable impact on the algorithm utilized for noise cancellation and/or the ultimate hearing percept evoked by the hearing percept. That said, in an alternate exemplary scenario of this embodiment, the first operating state can be a state in which the system is operating that is at least partially based on a previous own voice phenomenon, even though the recipient of the system is not speaking during the period of time in which the system operates in the first operating state. Indeed, this first operating state can be bifurcated into two states, such that there can be three or more operating states. A first operating state can be a state that is based on a previous voice phenomenon, even though the recipient is not speaking/vocalizing while the system is operating in the first operating state. A third operating state can be a state that is effectively not affected (including totally not affected) by an own voice phenomenon. In an exemplary embodiment, the system 400 operates in this third state/enters this third state in a scenario where a period of time has elapsed between a prior own voice phenomenon and a time in which the effects of own voice body noise are at least essentially entirely mitigated vis-à-vis operation of the adaptive noise cancellation sub-system. That is, the algorithm of the filter control unit operates utilizing variables that are not based on an own voice phenomenon, even in a residual manner. The second operating state can correspond to the second operating state detailed above.

It is noted that the adaptive noise cancellation sub-system can operate in a utilitarian manner in some instances where it is cancelling own voice body noise—it is when the own voice body noise is of a nature that it creates the above-noted deleterious effect that the system enters the second state. For example, the phoneme "EEEEEE" mentioned above can be one such own voice phenomenon evoking event, at least in some recipients. Accordingly, in an exemplary embodiment where the system operates in a first and second state, the second state corresponds to that above, and the first operating state is an operating state in which (i) the system operates while the recipient of the system is speaking, (ii) the adaptive noise cancellation sub-system cancels at least a portion of the own voice body conducted noise resulting from the speaking, and (iii) the adaptive noise cancellation sub-system is not affected by an own voice phenomenon (e.g., the values of phi of the adaptive noise cancellation algorithm of the adaptive noise cancellation sub-system do not head toward the limits and/or do not reach the limits and/or converge within a utilitarian time period).

As noted above, the system 400 is configured to control filter coefficients of the adjustable filters 450. The system 400 controls the filter coefficients in both the first operating state and the second operating state. However, the system 400 controls the filter coefficients in a different manner in the respective operating states. That is, the system 400 controls the filter coefficients according to a first control regime when the adaptive noise cancellation sub-system is in the first and/or third operating state(s), and controls the filter coefficients according to a second control regime when the sub-system is in the second operating state. Alternatively, the system 400 controls the filter coefficients according to a first control regime when the sub-system is in the first operating state, controls the filter coefficients according to a second control regime when the sub-system is in the second operating state, and controls the filter coefficients according to a third control regime when the sub-system is in the third operating state.

Some specifics of exemplary control regimes will now be described, along with an exemplary utility of utilizing those control regimes.

In an exemplary embodiment, the control regime by which filter coefficients of the adjustable filters 450 are controlled when the adaptive noise cancellation sub-system 460 is operating in the aforementioned second state (i.e., operation of the adaptive noise cancellation sub-system will be affected by an own voice phenomenon) is such that the filter coefficients are frozen at given value(s). In an exemplary embodiment, the filter coefficients are frozen at values corresponding the filter coefficient value(s) at the time of and/or just before the time of the onset of the own voice phenomenon that affects the operation of the adaptive noise cancellation sub-system. In an exemplary embodiment, the time of onset corresponds to the time that the own voice phenomenon was detected by the system. (Exemplary embodiments of detecting such are described below.) In an exemplary embodiment, the time of onset corresponds to the time that the own voice phenomenon was detected to affect the operation of adaptive noise cancellation sub-system and/or the time that it was determined that the own voice phenomenon was affecting or would affect the operation of the adaptive noise cancellation sub-system.

In an exemplary embodiment, by freezing the filter coefficients, the deleterious effects of the own voice body noise phenomenon are at least limited, if not entirely prevented. That is, even though the algorithm of the adaptive noise cancellation sub-system does not converge and/or the variables ramp to or towards their limits, etc., the filter coefficients are not being controlled based on the calculations of the adaptive noise cancellation sub-system during this period of non-convergence/variables ramping to their limits.

Alternatively and/or in addition to this, in an exemplary embodiment, the control regime by which filter coefficients of the adjustable filters 450 are controlled when the adaptive noise cancellation sub-system 460 is operating in the aforementioned second state (i.e., operation of the adaptive noise cancellation sub-system will be affected by an own voice phenomenon) is such that the control regime adjusts the filter coefficients to a different setting from that which would be the case in the absence of the control regime. That is, instead of utilizing the filter coefficients resulting from the adaptive noise cancellation sub-system being impacted by the own voice body noise phenomenon (i.e., the filter coefficients resulting from execution of the algorithm of the filter control unit 440 during real time, where the algorithm utilizes input influenced by the own voice phenomenon), the filter coefficients are set to other values, such as predetermined values, that are known to provide a utilitarian noise cancellation regime, albeit one that is not necessarily as optimal as might otherwise be the case. In an exemplary embodiment, the filter coefficients can correspond to those that correspond to a noise cancellation system that is not adaptive/does not have adaptive features. Put another way, if a logical progression of functionality of a hearing prosthesis includes a hearing prosthesis having (1) microphone input cancelled by a raw accelerometer signal, (2) microphone input canceled by an adjusted accelerometer signal adjusted in a non-adaptive manner, and (3) microphone input canceled by an adjusted accelerometer signal adjusted in an adaptive manner, the filter coefficients to which the adjusted filter coefficients correspond to those which would provide the hearing prosthesis the functionality of "1" and/or "2."

Still further, in an alternate exemplary embodiment, the control regime that controls the filter coefficients of the signal filter sub-system when the adaptive noise cancellation sub-system operates in the second state adjusts the filter coefficients to a different setting by extrapolating a value of the filter coefficients. The extrapolation can be via a linear extrapolation algorithm, or a non-linear extrapolation algorithm. In an exemplary embodiment, a Kalman filter or the like can be used estimated trajectory of the filter coefficients starting at the location of the onset of the impact of the own voice phenomenon/just before the impact of the own voice phenomenon. Alternatively, and/or in addition to this, a Kalman filter or the like can be used to estimate the trajectory of the parameters (e.g., posture parameters) of the algorithm of the adaptive noise cancellation sub-system. Various Kalman filters can be utilized, such as extended Kalman filters, unextended Kalman filters, particle filters, H infinity filters, and/or a combination of any of these filters alone or with other techniques detailed herein or variations thereof. In an alternate embodiment, auto regression or the like can be utilized. Linear auto regression or nonlinear auto regression can be used. Any device, system and/or method that will enable the extrapolation and/or an estimate of the trajectory of the noise cancellation parameters and/or other values that are calculated or estimated by the noise cancellation sub-system can be utilized in some embodiments.

That said, instead of freezing the filter coefficients and/or adjusting the filter coefficients, in an alternate embodiment, different algorithms are utilized depending on whether or not own voice body noise affects the noise cancellation sub-system. In this regard, according to an exemplary embodiment, with reference to the aforementioned first and/or third operating states of the noise cancellation sub-system, when the noise cancellation sub-systems operating in the affirmation first and/or third operating states, the adaptive noise cancellation sub-system operates according to a first algorithm. In an exemplary embodiment, this algorithm corresponds to that detailed herein and/or variations thereof. Conversely, when the adaptive noise cancellation sub-system operates according to the aforementioned second operating state, the adaptive noise cancellation sub-system operates in a deviant manner from the first algorithm. That is, during normal operation (e.g. operation not deleteriously affected by own voice body noise), the adaptive noise cancellation sub-system operates according to its normal operating algorithm—the filter control unit 440 runs its normal algorithm. Upon a determination that own voice body noise is affecting the operation of the sub-system, the operation sub-system deviates from that normal algorithm.

One exemplary manner of deviating from the normal algorithm entails suspending the execution of the adaptive noise cancellation algorithm, at least during the period during which the own voice body noise affects the adaptive noise cancellation sub-system. In an exemplary embodiment, this can entail suspending the entire algorithm. Alternatively, this can entail suspending a portion of the algorithm. For example, the algorithm can be suspended with respect to the calculation of certain parameters, such as for example, posture parameters, or the like. In an exemplary embodiment, this can correspondingly halt the calculations of phi until after the effects of the own voice phenomenon have subsided. This can result in the output of the filter control unit 440, during the period of suspension, corresponding to that at the time of suspension of the algorithm. In an exemplary embodiment, after a determination has been made that the own voice body noise phenomenon no longer affects the adaptive noise cancellation sub-system, the algorithm can resume from the point of suspension of execution and/or at another point. Alternatively, in an alternate embodiment, another exemplary manner of deviating from the normal algorithm entails exiting from the algorithm altogether. The "exiting" from the normal algorithm remains in place until after a determination has been made that the own voice body noise phenomenon no longer affects the adaptive noise cancellation sub-system, after which the filter control unit 440 can start execution of the algorithm at the beginning.

In another embodiment, suspension and/or exiting, etc., can be coupled with setting parameters of the algorithm to default parameters. For example, where parameters are posture parameters, the parameters can be set to parameters corresponding to a relaxed posture/a central posture (e.g., the phis are set at 0, 0). For example, the adaptive noise cancellation algorithm can cancel noise based on an assumption that the recipient is looking forward with his or her head level, and thus not leaned to one side or to the other side or looking upwards or downwards. That said, in an alternate embodiment, the default can be a parameter that corresponds to a more frequent posture of the recipient as compared to other postures. The frequency of posture can be evaluated over a limited period. For example, if in the preceding 10 seconds or so the recipient has looked to his right relatively frequently, the default can be parameters corresponding to such posture. Alternatively and or in addition to this, if a correlation between an occurrence of deleterious effects of body noise and posture parameters can be identified, the default can be to parameters that correspond to the posture parameters that result in the own voice body noise phenomenon, if only because of the increased likelihood that that is the posture of the recipient. For example, if the own voice phenomenon occurs more often when the recipient is looking towards the left, posture parameters related to the recipient looking towards the left can be the default parameters. The parameters may or may not be highly accurate. However, the parameters may be more accurate than simply setting the parameters at a general default.

Still further, in an alternate embodiment, yet another exemplary manner of deviating from the normal algorithm details entering a sub-algorithm of the normal algorithm that is usually not entered/is not utilized except in instances of own voice body noise, at least own voice body noise affecting operation of the adaptive noise cancellation sub-system. In this regard, the sub-algorithm can be a specific algorithm that, at least in part, addresses the specifics of own voice body noise phenomenon impact on the adaptive noise cancellation sub-system. By way of example only and not by way of limitation, in an exemplary embodiment, the sub-algorithm can constrain the increase and/or decrease of the aforementioned parameters (e.g., posture parameters)/phis, from one cycle/a group of cycles to another cycle/a group of cycles relative to that which might otherwise be the case. Still further by way of example only and not by way of limitation, in an exemplary embodiment, the sub-algorithm can set the parameters/phi values to different values from that which might otherwise be the case. Alternatively, and/or in addition to this, the update period for the algorithm can be extended (e.g., from one cycle to two or more cycles, cycles can be skipped vis-à-vis update, etc.). In an exemplary embodiment, the parameters (e.g., posture parameters) of the adaptive algorithm can be held at values of those parameters at the time of the onset and/or just before the time of onset of the own voice phenomenon affecting the operation of the adaptive noise cancellation sub-system. Still further, in an exemplary embodiment, the so-called learning time of the adaptive noise cancellation algorithm can be adjusted downward, such as to zero, or close thereto, in some embodiments.

Still further, in an exemplary embodiment, the adaptive noise cancellation algorithm can utilize additional parameters/variables to mitigate and/or eliminate the effects of own voice body noise on the cancellation algorithm. For example, the algorithm detailed above utilizes two phis. That is, it utilizes a two-dimensional algorithm. In alternative embodiment, a three dimensional, a four dimensional, or an algorithm having even higher dimensions can be utilized, at least providing that the computational power exists to execute such an algorithm in a manner that has utilitarian results of these of the evoking a hearing percept. In an exemplary embodiment, the algorithm can utilize two phis during some temporal periods (e.g., when a lack of ambient sound including voice content is identified, which can correlate to a low likelihood that the recipient will speak (because there is no one to speak to)), and then can utilize three or more phis during other temporal periods. In an exemplary embodiment, this transition can be automatic. In alternative embodiment, this transition can be manual. That is, the recipient can self-adjust the hearing prosthesis to operate using three or more phis. Indeed, it is noted herein that in at least some embodiments, some and/or all of the methods and/or actions detailed herein can be performed/commenced automatically and/or manually. In this regard, in at least some embodiments, the hearing prosthesis can be controlled, manually and/or automatically, such that it variously does execute and does not execute (or more accurately, is and is not enabled to execute) one or more or all of the methods and/or actions detailed herein. For example, the system can be prevented from and/or enabled to transitioning from the first state to a second state, automatically and/or manually.

In an exemplary embodiment, the parameters of the adaptive algorithm can be held at values of those parameters at the time of the onset and/or just before the time of onset of the own voice body noise phenomenon affecting the operation of the adaptive noise cancellation sub-system.

Accordingly, in view of the above, in an exemplary embodiment, the adaptive noise cancellation sub-system 460 includes a signal filter sub-system 450, wherein the system is configured to control a filter coefficient of the signal filter sub-system to effect noise cancellation according to a first algorithm when the adaptive noise cancellation sub-system is in the aforementioned first and/or third operating state. Additionally, system 400 is configured to control the filter coefficients of the signal filter sub-system 450 (that affects noise cancellation) according to a control regime different from that of the first algorithm, thereby adjusting operation of the adaptive noise cancellation sub-system 460 from the aforementioned first operating state and/or third operating state to the second operating state.

In an alternate embodiment, the hearing prosthesis system 400 is configured to address own voice body noise that affects the operation of the adaptive noise cancellation sub-system by canceling noise less aggressively in such scenarios. For example, when the adaptive noise cancellation sub-system is in the aforementioned second operating state, the adaptive noise cancellation sub-system cancels noise less aggressively than that which is the case when the adaptive noise cancellation sub-system is in the aforementioned first and/or third operation state. In an exemplary embodiment, this less aggressive noise cancellation is achieved by canceling noise at a lesser degree. In an exemplary embodiment, the canceled noise that is canceled to a lesser degree is body noise in general, and, in some embodiments, own voice body noise in particular. In an exemplary embodiment, the lesser degree corresponds to about a 30%, 40%, 50%, 60%, 70%, 80% or 90% or any value or range of values in between any of these values in increments of about 1% (e.g., about 40% to 67%, 55%, etc.) reduction in noise cancellation relative to that which would be the case in one or more of the other operation states. In an exemplary embodiment, this can be achieved by weighting various outputs of the noise cancellation sub-system.

Any device, system and/or method that can enable noise cancellation to a lesser degree relative that to that which would otherwise be the case such that the teachings detailed herein and or variations thereof can be practiced can be used in at least some embodiments.

There is thus an exemplary device, such as a hearing prosthesis utilizing the system 400, which includes an apparatus configured to receive signals indicative of the transduced energy originating from body noise. In an example of this exemplary device, the apparatus is configured to alter a functionality of a hearing prosthesis (e.g., noise cancellation, including activation and/or suspension thereof) upon a determination that a type of body noise is present and/or a change in a type of body noise has occurred based on data based on the received signals (e.g., the raw signals, a signal based on the role signal, codes received by a processor or the like based on the signals, a logic stream, etc.). In an exemplary embodiment, the aforementioned apparatus configured to generate the data based on an internal performance of a noise cancellation system (e.g. adaptive noise cancellation subsystem 460) that utilizes the signals indicative of the transduced energy originating from body noise. In accordance with the teachings detailed herein in an exemplary embodiment, that apparatus is configured to evaluate the signals indicative of the transduced energy and generate the data based on the evaluation of the signals.

As can be seen from the above, some embodiments utilize the onset of the own voice body noise event as a temporal boundary bifurcating parameters of the adaptive algorithm and/or filter coefficients into groups that are variously used, in a modified and/or unmodified state, depending on a particular implementation of the embodiment. In at least some exemplary embodiments, the system 400 is configured to identify the presence of the own voice body noise event, as will now be detailed.

Still with reference to FIG. 3B, system 400 includes a transducer system 480 that is configured to transduce energy originating from an acoustic signal (e.g., ambient noise) and from body noise. In an exemplary embodiment, the filter control unit 440 is configured to identify the presence of an own voice event based on the transduced energy outputted by the transducer system 480. In this regard, in at least some embodiments, filter control unit 440 has the functionality of a classifier in that it can classify the output signals from the transducers as having an own voice body noise content and/or not having an own voice body noise content (or as having a non-own voice body noise content and/or not having such, or simply having a body noise content and/or not having a body noise content, etc.) That said, in an alternate embodiment, a separate control unit from the filter control unit 440 is so configured. It is noted that identification of the presence of an own voice body noise event encompasses identification of the absence of an own voice event, at least in view of the binary nature of the presence/absence thereof. Any arrangement that can enable the identification of the presence of an own voice event based on the transduced energy outputted by the transducer system 480 can be utilized in at least some embodiments. Some exemplary methods of/systems for doing such are detailed below.

Figure 12A:
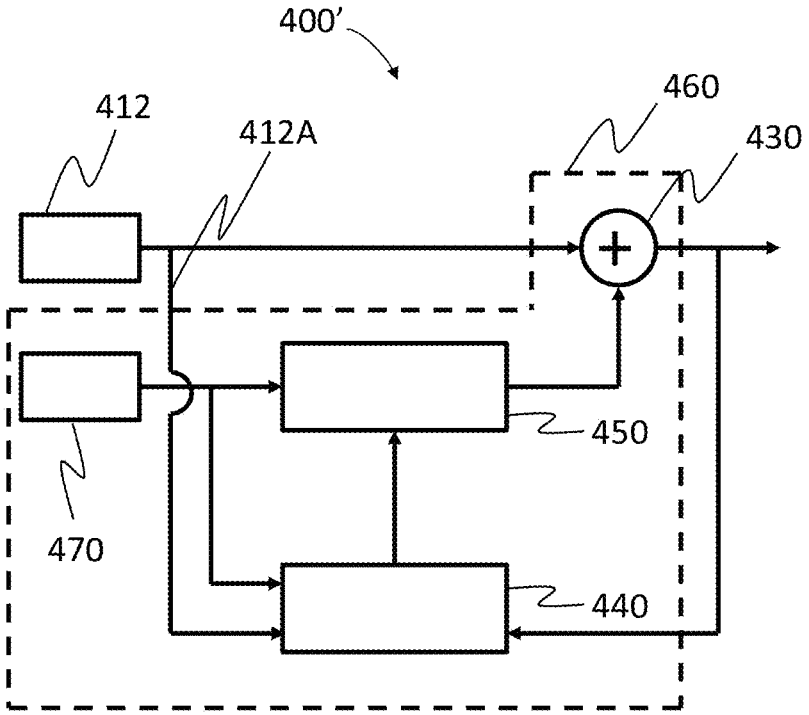
FIG. 12A functionally depicts another exemplary embodiment of a system that is usable in the hearing prosthesis of FIG. 1 that functionally operates in accordance with the schematic of FIG. 3A.

Accordingly, FIG. 12A depicts a system 400', which is a variation of the system 400 of FIG. 12A. It is noted at this time that any reference to system 400' corresponds to a reference to system 400, system 400" (discussed below) and system 400'" (also discussed below), unless otherwise noted, just as a reference to system 400" corresponds to a reference to system 400, 400', 400'", and so on. As can be seen, there is a direct signal route 412A from the microphone 412 to the filter control unit 440. Thus, the system 400' in general, and control unit 440 in particular, is configured to compare or otherwise evaluate the raw outputs of the microphone 412 and the accelerometer 470 and identify the presence of an own voice body event based on these raw outputs. That said, in an alternate embodiment, the outputs can be amplified and/or otherwise signal processed between the transducers and the control unit, or after the control unit, etc. In an embodiment of the system 400', the control unit 440 is configured such that it receives outputs from the transducers simultaneously without cancellation, even in the presence of noise cancellation. (Conversely, in the embodiments of FIG. 3B, the control unit 440 could simultaneously receive outputs from both the transducers without cancellation, but only in the absence of the noise cancellation. Still, in at least some embodiments of FIG. 3B, because the amount of cancellation resulting from the signal having passed through adder 430 is known, the output of microphone 412 without cancellation can be calculated by simply "adding" the equivalent of the canceled signal back into the signal that is received by the filter control unit 440 that originates downstream of the adder 430.)

In an exemplary embodiment of the system 400, the system is configured to compare a parameter that is related to transduced energy originating from the acoustic signal to a parameter related to transduced energy originating from the body noise. The system is further configured to identify the presence (and thus identify the absence) of an own of voice event based on the comparison. Some additional details of such an exemplary embodiment are described below.

Now with reference back to FIG. 3B, and in view of FIG. 3A, the system 400 is configured to cancel body noise energy from signal(s) output by the transducer system 480 that includes energy originating from the aforementioned acoustic signal (the ambient noise signal 103). In an exemplary embodiment, this cancellation of body noise is executed by the system 400 during some modes of operation, such as a mode of operation in which the system operates in the absence of an identification by the aforementioned control unit of an identification of the presence of the own voice body noise event. That is, in an exemplary embodiment, the system 400 is configured to alternately cancel body noise energy from the transducer signal depending on a mode of operation. In this regard, if the system 400, via the control unit 440, does not identify the presence of an own voice event and/or identifies the absence of an own voice event, the system operates to cancel body noise. (In an exemplary embodiment, it operates to cancel body noise according to the adaptive methods, systems, and/or devices detailed herein and/or variations thereof.) That said, this does not exclude the cancellation of body noise energy from the transducer signal during the mode of operation where the control unit identifies the presence of an own voice body noise event, although in some embodiments, the system is so configured such that cancellation of body noise energy from the transducer signal is suspended during such a mode of operation.

It is noted that some embodiments of the just-detailed embodiment are compatible with at least some of the aforementioned teachings above. Thus, in an exemplary embodiment, at least some of the aforementioned teachings are combined with such an embodiment. In this vein, in an exemplary embodiment, the system 400 (or 400', etc.) is configured to cancel body noise energy from the transducer signal that includes energy originating from the acoustic signal differently/in a different manner, depending on whether the control unit has identified the presence (or absence) of the own voice body noise event. That is, the cancellation of body noise energy from the transducer signal upon an identification of the presence of the own voice event is performed differently from that which would be the case in the absence of the identification of the presence of the own voice event.

Still with reference to FIG. 3B, there is an exemplary embodiment of the system 400 that adjusts a mixing ratio of outputs from the microphone 412 and the accelerometer 470 on the identification of an own voice body noise event. More particularly, microphone 412 is configured to transduce energy originating at least in part from the acoustic signal, and accelerometer 470 is configured to transduce energy originating from body noise, where the latter is effectively isolated from energy originating from the acoustic signal concomitant with the teachings detailed above associated with the accelerometer. In this embodiment, the noise cancellation system 460 (whether it be in adaptive noise cancellation system or a standard (non-adaptive) noise cancellation system), is configured to affect the cancellation of the body noise energy from a transducer signal (e.g., the output from the microphone 412) that includes the energy originating from the acoustic signal. The system is further configured to adjust a cancellation system mixing ratio of output from the microphone 412 and output from the accelerometer 470 upon the identification of the own voice event. In the embodiment of FIG. 3B, the cancellation system mixing ratio is adjusted by adjusting the adjustable filters 450, which, in at least some embodiments, adjusts the magnitude of the signal passed therethrough. That said, in an alternate embodiment, a separate component can be utilized to adjust the mixing ratio. In an exemplary embodiment, adder 430 is controlled to adjust the mixing ratio.

Some exemplary embodiments have utilitarian value by being configured to adjust the mixing ratio such that output from the accelerometer 470 has less influence on the cancelation system relative to that which would be the case in the absence of the identification of the own voice event. In an exemplary embodiment, the mixing ratio can be reduced to zero such that the output from the accelerometer 470 has no influence on the cancellation system relative to that which would be the case in the absence of the identification of the own voice event.

In view of the above, some exemplary embodiments can be considered in terms of a hearing prosthesis having a noise cancellation system in general, and an adaptive noise cancellation system in particular, with a flexible sound path. Some specific embodiments of such exemplary embodiments will now be described in terms of varying this "sound path." However, it is noted that in alternative embodiments, signal processing techniques can be utilized to achieve the same and/or similar effects. In this regard, any disclosure herein relating to the variation and or adjustment of a sound path to enable the teachings detailed herein and/or variations thereof also corresponds to a disclosure of utilizing a sound processor system to achieve that functionality and/or variation thereof.

With reference to FIGS. 3B and 12A, as can be seen, the sound path between the microphone 412 and the downstream side of the adder 430 (which can lead to a signal processor and/or an output device, as detailed above) can be influenced by the adder 430. In some embodiments, the functionality of this adder can be disabled, such that the signal from microphone 412 passes to components downstream of the system depicted in FIGS. 3B and 12A (e.g., a stimulator of an electrode array, an actuator, a sound processor, etc.) without cancellation by the noise cancellation subsystem 460. In a variation of this concept, a signal path can be provided that completely bypasses the adder 430 via the use of switching or the like. That is, for example, the signal from the microphone 412 can be sent through adder 430, or can be switched to bypass the adder 430. Still further, in a variation of this concept, the output of the microphone 412 can include a path to the adder 430 and a path that bypasses the adder 430, and the switching unit can be utilized to switch between these two paths to control which signal (a signal subjected to noise cancellation or a raw/non cancelled signal) is delivered to the components downstream of the system 400/400'.

In at least some exemplary embodiments, if the control unit 440 (which can correspond to a classifier that classifies the outputs of the transducers as having own voice body noise content or not having own voice body noise content), or other control unit separate from the control unit 440, determines that there exists an own voice body noise content to the outputs of the microphone 412 and/or the accelerometer 470, the control unit 440 can control the system such that no noise cancellation takes place. (In an exemplary embodiment, this can entail eliminating the outputs of filters 450 to adder 430 and/or bypassing the adder 430 according to the aforementioned switching techniques etc.) Otherwise, in the absence of a determination of the presence of own voice body noise, the control unit 440 controls the system such that noise cancellation takes place in a normal manner to cancel out generally as much of the body noise as technology can enable. That said, in an alternate embodiment, if a determination is made that there exists the presence of own voice body noise, the control unit 440 can control the system such that less noise cancellation takes and/or the noise cancellation that takes place is different from that which would be the case in the absence of such a determination.

In this regard, an exemplary embodiment can have utility in that the lack of cancellation of own voice body noise from the signal from the microphone 412 (or cancellation in a different manner from the normal scenario)/the inclusion of own voice body noise (or a portion of such) in the signal that is outputted from the system 400/400', and the subsequent utilization of those signals to evoke a hearing percept, can result in a more natural hearing percept. In this regard, normal hearing persons hear their own voice via tissue conduction (bone/skin conduction etc.). This is why one can hear themselves speak even though he or she covers his or her ears. Canceling own voice body noise with the goal of reducing the effect of unwanted body noise to achieve a more normal hearing percept can, in some instances, actually cause a hearing percept that sounds less normal than otherwise might be the case. Put another way, some embodiments of this embodiment can have utility in that it can enable a hearing impaired person to have a hearing percept that has a content corresponding to his or her own voice resulting from tissue conduction. This can be in addition to the hearing percept that has a content corresponding to his or her own voice resulting from air conduction (i.e., content resulting from pressure waves exiting the mouth of the recipient resulting from speaking, etc., and traveling through the air to impinge upon the skin of the recipient, and then conducted through the skin of the recipient to the microphone 412, where it is transduced into an output signal). Conversely, completely and/or substantially eliminating all body noise from the output of the systems, including eliminating own voice body noise, can result in a unnatural sound, which can be annoying or otherwise irritating, at least to recipients who have previously had natural hearing. This can result in a hearing percept having an echo character and/or can result in a hearing percept aware the recipient has a percept of his or her own voice, but that percept has a "boomy" quality to it. Thus, an exemplary embodiment can provide a hearing percept where these features are mitigated and/or eliminated.

Figure 12B:
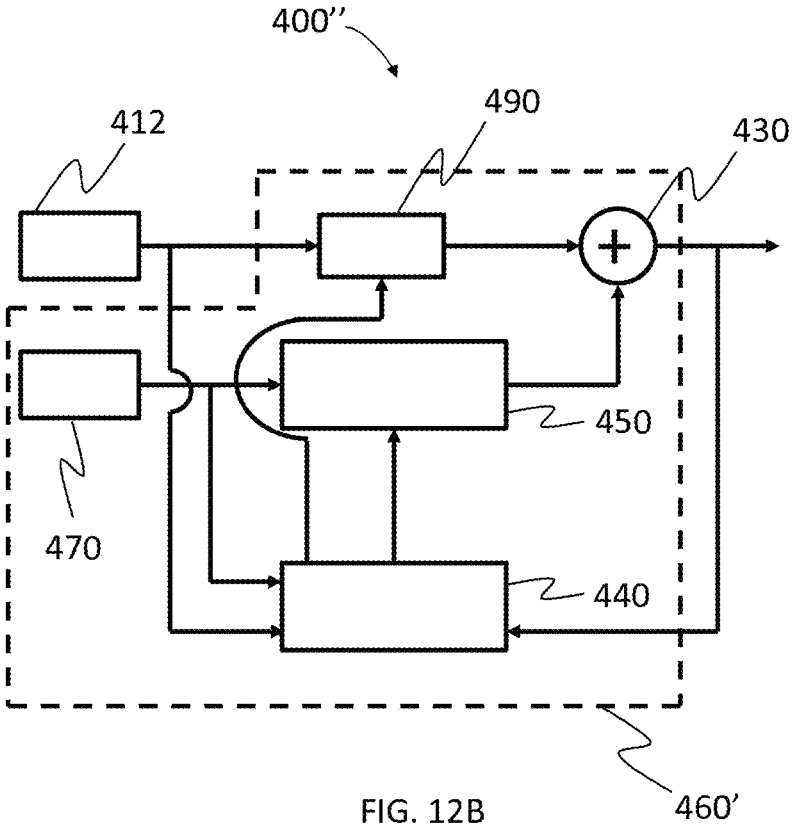
FIG. 12B functionally depicts another exemplary embodiment of a system that is usable in the hearing prosthesis of FIG. 1 that functionally operates in accordance with the schematic of FIG. 3A.

Continuing with reference to FIGS. 3B and 12A, in an exemplary embodiment, the signal path between microphone 412 and the adder 430 and/or the signal path between microphone 412 and the output of the systems 400/400' is configured such that the output of that path results in a hearing percept that has balance between the recipient's own voice and external sounds, including external speech. In an exemplary embodiment, the signal path is optimized for such balance. That is, in an exemplary embodiment, the signal path is established such that the hearing percept resulting from a non-noise canceled signal corresponds more closely to a normal hearing experience, at least in the absence of non-own voice body noise, relative to that which would be the case if noise cancellation took place (at least aggressive/full noise cancellation implementation). In some embodiments, the aforementioned path results in broad band attenuation, where the amount of attenuation is tuned for balance between own voice content and external sounds, including external speech. In an exemplary embodiment, this can have utility in that a broadband attenuator can have a spectral balance of own voice content that is not altered or otherwise limited in its alteration, and thus retaining natural quality, or at least a quality relatively closer to that more natural quality. In this vein, FIG. 12B depicts system 400", which corresponds to any of the prior systems, but further includes an adaptive noise cancellation sub-system 460' including a signal processor 490 interposed between microphone 412 and adder 430 (although in an alternate embodiment, the processor 490 can be located downstream of the adder 430). In the exemplary embodiment of FIG. 12B, signal processor 490 is in signal communication with control unit 440 as can be seen. Control unit 440 (or another control unit) controls signal processor 490 to process the output of microphone 412 in one or more manners (one of which is to allow the signal to passed therethrough without processing) depending on whether or not a determination has been made that an own voice event has been detected. In this regard, if a determination has been made one or both of the transducer output signals contains an own voice body noise content, and noise cancellation is suspended and/or otherwise altered from that which would be the case in the absence of such a determination, the signal processor 490 can process the output signal to optimize the resulting hearing percept or otherwise alter the hearing percept from that which would be the case without the actions of the signal processor 490. An exemplary embodiment of such can have exemplary utility in that an own voice signal can be processed in a manner differently from ambient noise signals. In some exemplary embodiments, this is done to account for the fact that the microphone signal 412 can include both a body noise component and a component resulting from sound traveling through the air from the recipient's mouth resulting from speech or the like. That is, the signal 412 can be modified in a non-noise cancellation manner when processor 490 is activated. Accordingly, in an exemplary embodiment, the amount of attenuation in this path can be adjusted towards and/or away from external noise/own voice speech balance, irrespective of whether noise cancellation takes place.

Figure 12C:
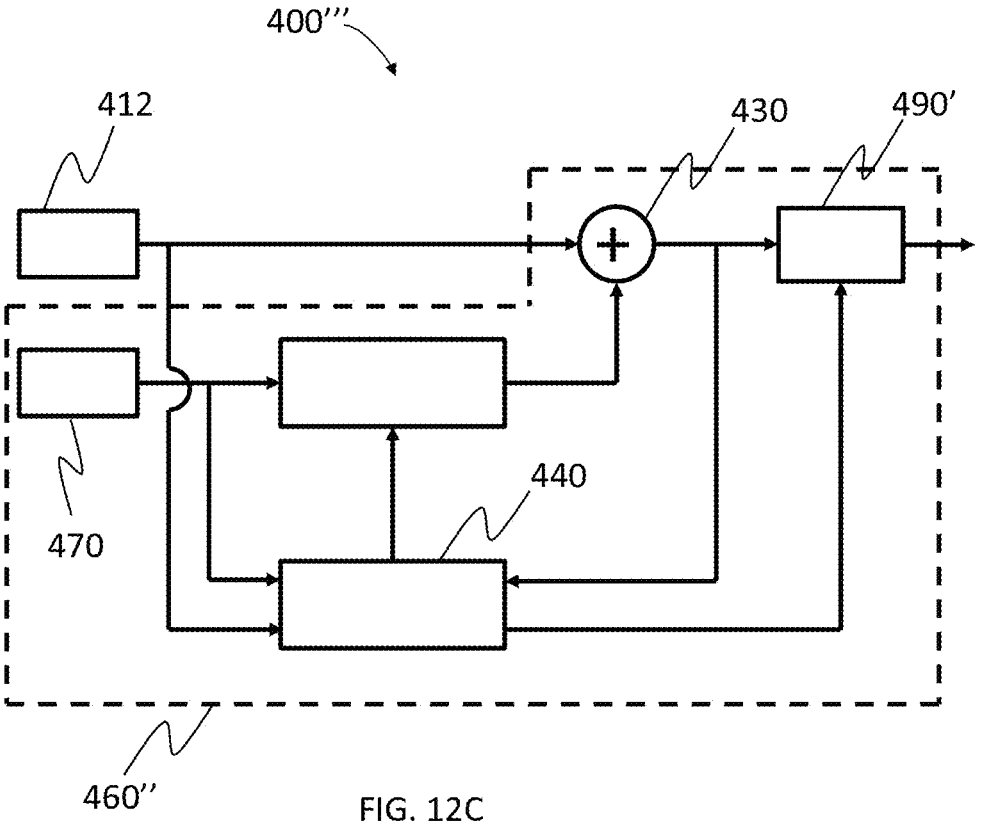
FIG. 12C functionally depicts another exemplary embodiment of a system that is usable in the hearing prosthesis of FIG. 1 that functionally operates in accordance with the schematic of FIG. 3A.

Now with reference to FIG. 12C, there is a system 400''', which corresponds to any of the other systems detailed herein, where the adaptive sound cancellation sub-system 460" includes a signal processor 490' that is located downstream of adder 430. In an exemplary embodiment, the signal processor 490' is controlled by control unit 440 (or another control unit). In an exemplary embodiment of this embodiment, the system 400''' is configured such that upon a determination that an own voice body noise event has occurred, an own voice body noise content is added back to the canceled signal after cancellation at the adder 430. That is, in an exemplary embodiment, full or substantially full adaptive noise cancellation takes place, which can include the cancellation in part or in whole of own voice body noise from the output of microphone 412. Then, the output signal from the adder 430 is processed by signal processor 490' such that a hearing percept based on the output of system 400''' includes a substantial content corresponding to own voice body noise. In an exemplary embodiment, signal processor 490' processes the output signal from adder 430 such that a hearing percept based on the output of system 400''' after an own voice body noise event has occurred (i.e., during an own voice body noise event) corresponds more closely to normal hearing relative to that which would be the case in the absence of the actions of processor 490'.

As noted above, embodiments of the hearing prosthesis systems detailed herein and/or variations thereof can include a device that has the functionality of a classifier. In an exemplary embodiment, this classifier can discriminate between one or more or all of a signal containing own voice body noise content, a signal containing non-own voice body noise content, a signal containing non-own voice body noise content and not containing own voice body noise content, a signal containing own voice body noise content and not containing non-own voice body noise content, a signal containing an ambient sound content, and/or a signal containing silence content/indicative of silence. In an exemplary embodiment, the systems detailed herein and/or variations thereof are configured to control the outputs thereof based one or more of the aforementioned discriminations (i.e., a determination that one or more of the aforementioned signal content scenarios exist). By way of example only and not by way of limitation, an embodiment includes a system configured to halt or otherwise modify the adaptive noise cancellation upon a determination that there is own voice content in the signals, silence content in the signals, and/or external/ambient sound content in the signals. Still further by way of example only and not by way of limitation, an embodiment includes a system configured to enable or otherwise implement adaptive noise cancellation to its fullest extent upon a determination that there is body noise content that is present in the signals. Still further by way of example only and not by way of limitation, an embodiment includes a system configured to enable or otherwise implement adaptive noise cancellation to its fullest extent upon a determination that there is non-own voice body noise content that is present in the signals, at least upon a determination that there is no own voice body noise content that is present in the signals.

Still further by way of example only and not by way of limitation, an exemplary embodiment includes executing noise cancellation, and freezing the adaptive noise cancellation filters upon a determination that the signal content of one or more of the transducers include own voice body noise content, silence content, and/or ambient sound content. An exemplary embodiment includes executing adaptive noise cancellation only when body noise is present, at least non-own voice body noise.

It is noted that the teachings detailed herein relate, at least in part, to transitioning between different states of the hearing prosthesis in general, and different states of the adaptive noise cancellation sub-system in particular. Some exemplary embodiments include systems that are configured to smooth or otherwise step the transition between these states. That is, the systems are configured such that the hearing percept that results from the prosthesis transitioning from one state to the other corresponds more closely to a normal hearing percept as compared to that which would be the case in the absence of such smoothing. In an exemplary embodiment, an impulse noise filter or the like can be utilized. In some embodiments, the impulse noise filter can be controlled to the activated only during the times of transition. Any device system and/or method that can enable the smoothing or the like detailed herein and are variations thereof to be practiced can utilize in at least some embodiments.

Some exemplary embodiments include methods, such as, for example, operating a system/hearing prosthesis, as will now be detailed.

As a preliminary matter, it is noted that embodiments include a method of operating or otherwise utilizing any device and/or system detailed herein and/or variations thereof. Also, embodiments include a device and/or system configured to execute any method detailed herein and/or variations thereof. It is further noted that any teaching detailed herein and/or variation thereof can be performed in an automated/automatic manner. Thus, exemplary embodiments include devices implements and/or systems that automatically execute any one or more of the teachings detailed herein. Further, exemplary embodiments include methods that entail automatically executing one or more of the teachings detailed herein.

Figure 13:
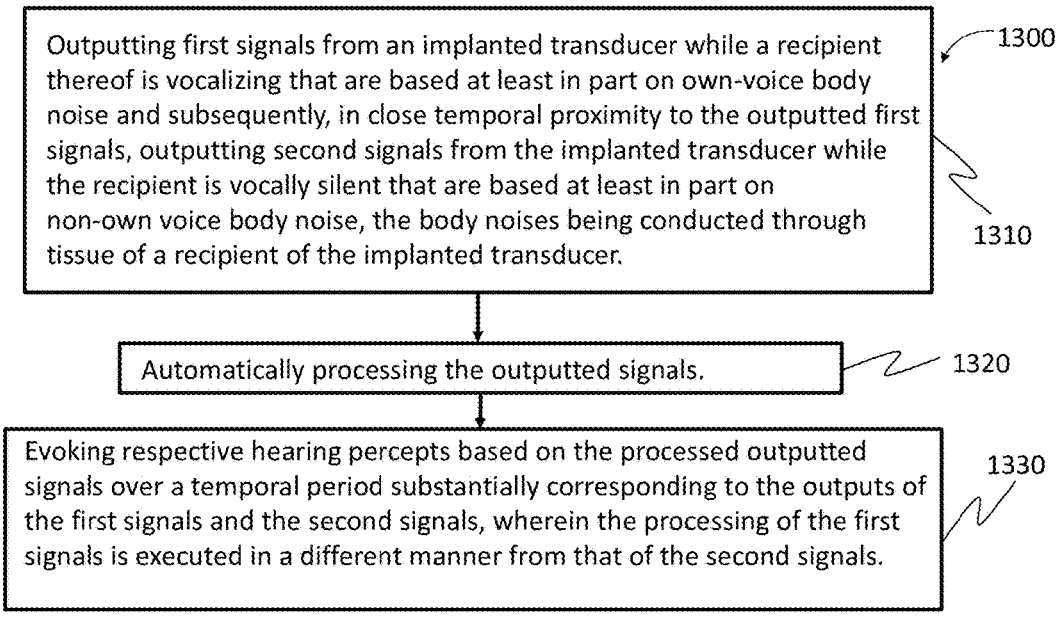
FIG. 13 depicts a flow chart for an exemplary algorithm.

Referring now to FIG. 13, which presents an exemplary algorithm 1300 according to an exemplary method, there is a method that entails an action 1310 of outputting first signals from an implanted transducer (e.g., microphone 412) while a recipient is vocally silent (i.e., not making sounds associated with utilization of the vocal cords, and thus not generating own voice body noise). These first signals are based at least in part on non-own voice body noise, although in an exemplary embodiment, the first signals are totally based on non-own voice body noise. Action 1310 entails subsequently, in close temporal proximity to the outputted first signals (e.g., within the temporal boundaries of a conversation, within tens of seconds, etc.), outputting second signals from the implanted transducer while the recipient is vocalizing (i.e., making sounds associated with utilization of the vocal cords) that are based at least in part on own voice body noise. It is noted that in alternate embodiments, action 1310 is not so temporally restricted. Instead, the temporal proximity relates to a minute or two. In some embodiments, there is no temporal restriction. In action 1310, the body noises are conducted through tissue of a recipient of the implanted transducer. In action 1310, in at least some embodiments, when the recipient is vocally silent, and thus not generating own voice body noise, the outputted first signals outputted from the implanted transducer are not based on own voice body noise.

It is noted that in at least some embodiments, the first signals and/or second signals can be based, at least in part, on the acoustic signal/ambient noise that results in pressure waves in impinging upon the surface of the skin of the recipient, wherein these pressure waves cause subsequent pressure waves to travel through skin of the recipient to the implantable transducer, such that the implantable transducer transduces the ambient sound.

Algorithm 1300 includes an action 1320 of automatically processing the outputted signals from the implanted transducer, with the caveat below. Action 1320 can be accomplished utilizing a sound processor and/or any type of system that can enable automated processing of the outputted signals to execute the method of algorithm 1300. It is noted that by "processing the outputted signals," it is meant both the processing of signals that are outputted directly from the microphone 412, and the processing of signals that are based on the output from the microphone 412.

Algorithm 1300 further includes action 1330, which entails evoking respective hearing percepts based on the processed outputted signals over a temporal period substantially corresponding to the outputs of the first signals and the second signals, wherein the processing of the first signals is executed in a different manner from that of the second signals. By way of example only and not by way of limitation, processing of signals in a different manner from that of the second signals can entail any of the regimes detailed herein and/or variations thereof associated with managing otherwise addressing the own voice body noise phenomenon.

It is noted that some exemplary embodiments of the method of algorithm 1300 entail processing signals based on ambient sound that has been conducted through the tissue of the recipient in the same manner as the signals that are based on an own voice body noise and/or in the same manner as a signals that are based on a non-own voice body noise. That is, in an exemplary embodiment, the presence or absence of the own voice body noise in a given signal can control how the outputs of the microphones are processed.

In at least some embodiments of the method of algorithm 1300, the implanted transducer can also transduce energy resulting from ambient noise traveling through the tissue of the recipient. Accordingly, in an exemplary embodiment, the first signals and/or the second signals are based in part on ambient noise conducted through tissue of the recipient. Accordingly, the hearing percept evoked based on the signals can, in some instances of this embodiment, include an ambient noise component, and thus signals indicative of ambient noise can be processed differently depending on whether there is an own voice content to the signal and/or depending on whether there is a non-own voice content to the signal.

In an alternate embodiment of the method of algorithm 1300, third signals are outputted from the implanted transducer in close temporal proximity to the outputted first signals. These third signals are based at least in part on ambient noise conducted through tissue of the recipient. In an exemplary embodiment, these third signals are not based on non-own voice body noise. These third signals are processed, and a hearing percept is based on the processed third signals. In this embodiment, the processing of the third signals is executed in the same manner as that of the first signals. Conversely, in another embodiment, the third signals are based at least in part on ambient noise conducted through tissue of the recipient, and are also based at least in part on non-own voice body noise. The outputted third signals are processed, and a hearing percept is evoked based on the processed signals. However, in this embodiment, the processing of the third signals is executed in a different manner from that of the first signals. In an exemplary embodiment, the processing of the third signals is executed in the same manner from that of the second signals. In a variation of this latter embodiment, the third signals from the implanted transducer are not based on own voice body noise. That is, the body noise is completely free of own voice body noise content.

The method of algorithm 1300 can further include the action of determining that own-voice phenomenon has commenced. In an exemplary embodiment, this can be achieved via any of the methods and/or devices detailed herein. The method of algorithm 1300 can further include the action of adjusting the processing of the outputted signals from that which was the case prior to the determination of the commencement of the own-voice phenomenon based on the determination such that the processing of the second signals is executed in a different manner from that of the first signals.

In at least some exemplary embodiments, the action of determining that an own-voice phenomenon has commenced includes analyzing signals from the implanted transducer (e.g., microphone 412) and/or analyzing signals from a second implanted transducer (e.g., accelerometer 470) isolated from ambient noise and determining that an own-voice phenomenon has commenced based on at least one of the respective energies of the respective signals. For example, a determination that the signals from the second implanted transducer have a relatively high energy level can be indicative of own voice body noise. This can be relative to the energy level (i.e., a relatively lower energy level) indicative of silence with respect to body noise. This can also be relative to the energy level indicative of non-own voice body noise, at least in recipients where the own voice body noise results in a relatively higher energy level than body noises that do not contain an own voice component.

Note further that the aforementioned exemplary scenarios in the paragraph just preceded can occur in a scenario where the recipient is in an environment where he or she is not exposed to an external sound/ambient noise and in a scenario where the recipient is in an environment where he or she is exposed to an external sound/ambient noise. By way of example only and not by way of limitation, in at least some exemplary embodiments, the action of determining that an own-voice phenomenon has commenced further includes analyzing signals from the first implanted transducer (e.g., microphone 412) and/or analyzing signals from a second implanted transducer (e.g., accelerometer 470) isolated from ambient noise and determining that an own-voice phenomenon has commenced based on at least one of the respective energies of the respective signals and determining the ambient context in which the own-voice phenomenon has commenced (e.g., silence, external sound, external speech, etc.) also based on at least one of the respective energies of the respective signals.

For example, a determination that the signals from the first implanted transducer have a relatively low energy level can be indicative of an ambient context corresponding to an ambient environment of silence and/or of low level background noise (e.g., white noise, which can include sea noise, traffic noise, mechanical component operation noise, etc.). If a determination is also made that the signals from the second implanted transducer have a relatively high energy level, a determination can be made that there exists own voice body noise in the context of an ambient environment of silence and/or low level background noise. Conversely, if determination is also made that the signals from the second implanted transducer have a relatively low energy level, a determination can be made that there exists no own voice body noise in the context of an ambient environment of silence and/or low level background noise. Again, this can also be relative to the energy level indicative of non-own voice body noise, at least in recipients where the own voice body noise results in a relatively higher energy level than body noises that do not contain an own voice component. That is, even if the signal from the second implanted transducer has a relatively higher energy level, if that energy level is still not as high as that which would be the case in the presence of own voice body noise, a determination can be made that the energy level corresponds to non-own voice body noise/body noise not having a component of the own voice noise therein. Thus, a determination can be made that the signals from the implanted transducers are indicative of non-own voice body noise in the context of an ambient environment of silence and/or low level background noise.

Still further by example, a determination that the signals from the first implanted transducer have a relatively high energy level can be indicative of an ambient context corresponding to an ambient environment of external sound, which can include external speech and/or external speech directed at the recipient. If a determination is also made that the signals from the second implanted transducer have a relatively high energy level, a determination can be made that there exists own voice body noise in the context of an ambient environment of external sound. Conversely, if determination is also made that the signals from the second implanted transducer have a relatively low energy level, a determination can be made that there exists no own voice body noise in the context of an ambient environment of external. Again, this can also be relative to the energy level indicative of non-own voice body noise, at least in recipients where the own voice body noise results in a relatively higher energy level than body noises that do not contain an own voice component, as noted above.

It is noted that additional processing can be utilized to evaluate whether the ambient environment corresponding to external sound corresponds to speech in general and speech directed towards the recipient particular. Such processing can be implemented upon a determination that one or more of the signals from the transducers have a relatively high energy level and/or can be implemented regardless of the energy level of the signals from the transducer.

In some exemplary embodiments, the action of determining that an own-voice phenomenon has commenced includes analyzing the parameters of the adaptive noise cancellation algorithm. If the analysis identifies that the parameters are ramping up towards their limits and/or are at their limits, and/or that the parameters are not converging, this can be utilized as an indication that an own voice phenomenon has commenced. Thus, the parameters can be used not only as latent variables with respect to posture or the like, but also can be used as latent variables to detect or otherwise identify the presence of own voice body noise, or at least the presence of own voice body noise that can result in a deleterious effect as detailed herein and/or variations thereof.

Moreover, in at least some embodiments, a feature can be included in the systems that enables the system to learn, over a period of time, when an own voice event has occurred, and thus forecast when an own-voice event will occur or otherwise determine that an own voice in that event has commenced. For example, the system can evaluate various aspects of the signals and/or evaluate various aspects of the operations of the algorithms to correlate certain observed features to an own voice event. For example, the system can evaluate the power in a certain frequency band of the outputs of one or both transducers, and correlate such to the occurrence of a own voice event. The occurrence of the own voice event can be determined based on the performance of the algorithm (e.g., the parameters heading towards or hitting their limits, etc.), and/or on input from the recipient, etc. Still further, change characteristics of operation of the system (e.g., the output signals, results of the algorithms, etc.) can be utilized in at least some embodiments. For example, in some embodiments, the power of certain frequency bands may change in a given manner that is repeated during own voice events, thus indicating an own voice phenomenon. Still further by example, in some embodiments, the performance of the algorithm may change in a given manner, also thus indicating an own voice phenomenon. Accordingly, there is a device configured to evaluates the powers of certain frequency bands to determine whether or not an own voice phenomenon has occurred. There is further a device configured to evaluate the performance of the adaptive noise cancellation algorithms to determine whether or not own voice phenomenon has occurred.

In some embodiments, a separate unit that determines or otherwise estimates the probability of an own voice event, or at least the probability of an own voice event that causes one of the deleterious results detailed herein and/or variations thereof, can be included in the hearing prosthesis systems. In an exemplary embodiment, the separate unit can be utilized to control or otherwise activate the Kalman filter(s), or to implement the sub-algorithm or to suspend the algorithm, etc. In some embodiments, such a separate unit can be utilized to transition the adaptive noise cancellation subsystem from one state to the other.

Indeed in an exemplary embodiment, any system that can detect own voice phenomenon can be utilized. Such a system can utilize latent variables and/or can utilize direct sensors (e.g. a sensor that detects vibrations of the vocal cords, etc.). An exemplary system can measure or otherwise evaluate the output from the accelerometer and utilize that to classify or otherwise make a determination that an own voice phenomenon has occurred.

Alternatively and/or in addition to this, in at least some exemplary embodiments, the action of determining that an own voice phenomenon has commenced includes analyzing a spectral content of signals from an implanted transducer (e.g., the microphone 412 and/or the accelerometer 470) and determining that an own-voice phenomenon has commenced based on the spectral content. In an exemplary embodiment, a spectral content corresponding to a relatively high frequency is indicative of own voice body noise. Conversely, the absence of a relatively high frequency is indicative of non-own voice body noise. By way of example only and not by way of limitation, in some embodiments, frequencies above 250, 500, 750, 100, 1250, 1,500, 1,750 or 2,000 Hz or more or any value or range of values therebetween in about 10 Hz increments corresponds to a relatively high frequency/frequency indicative of own voice. In a similar vein, the pitch of the body noise can be analyzed analyzed. Autocorrelation or the like can be utilized to analyze the output signal and identify or otherwise estimate the pitch of the body noise. Based on the pitch, a determination can be made whether or not the bodily noise has an own voice component.

In view of the above, in an exemplary embodiment, the system 400 is configured to receive signals indicative of transduced energy originating from body noise (e.g., from microphone 412 and/or accelerometer 470). The system 400 is further configured to evaluate the received signals and determine that the received signals are indicative of a first type of body noise (e.g., own voice body noise) as differentiated from a second type of body noise (e.g., non-own voice body noise). In the case where the system 400 is a hearing prosthesis, the system is configured to transduce energy originating from ambient sound and evoke a hearing percept based thereon. In an exemplary embodiment, the device is configured to automatically change operation from a first manner to a second manner if a determination has been made that the received signals are indicative of the first type of body noise. Still further, in an exemplary embodiment, the system is configured to transduce energy originating from ambient sound and evoke a hearing percept based thereon. The evoked hearing percept is evoked in a first manner (e.g., the adaptive noise cancellation algorithm is suspended) if a determination has been made that the received signals are indicative of the first type of body noise (e.g., own voice body noise), and evoke the hearing percept in a second manner (e.g., with adaptive noise cancellation) if a determination has been made that the received signals are indicative of the second type of body noise (e.g., non-own voice body noise).

In at least some embodiments, the embodiments mitigate issues associated with cancellation algorithms of other hearing regimes utilized in hearing prostheses, such as the devices, methods and apparatus used for cancelling out acceleration pressure signals, some of which are based on purely physical methods, while others use electronic and/or digital signal processing; the former methods typically removed 10-15 dB due to the difficulty of matching the physical frequency responses of the microphone response and the accelerometer response; the latter are successful at removing much larger amounts of feedback in the 25-55 dB range needed for good acceleration feedback cancellation, and can be used for smaller amounts of feedback cancellation as well. One of the problems with such cancellation methods is that they depend upon a specific transfer function for the acoustic/acceleration signal (which may be frequency dependent), or a software model for determining the transfer function. The transfer function is not fixed but changes with posture, which is one of the problems with a physical model for cancellation, and contributes to the difficulty in matching the microphone response to the accelerometer response. A DSP solution to the cancellation problem can use an explicit or implicit software model to estimate the transfer function through a variety of algorithms. However, when body generated signals generate a substantially different transfer ratio of acoustic signal to vibration signal from what is normally encountered with body generated signals, they interfere with this estimation process. This interference can cause a deficiency of the estimation process, resulting in poor cancellation of vibration signals. This can be deleterious if reduction of cancellation causes the loop gain of an implantable middle ear transducer to exceed 1 and thereby go into oscillation. This occurs particularly with own voice, because own voice can have a large acoustic signal, but may also present a large relative vibration signal, and the ratio of acoustic to vibration signals is substantially different from, say, mechanical feedback from the actuator. Whether or not the recipient experiences oscillation can depend on the placement of the microphone, anatomy, recipient fitting, and amplitude of the signal, which are difficult or impossible to access before implantation. This may result in the occasional implantation recipient having an unsatisfactory outcome that could not be predicted before implantation, and represents a substantial risk. At least some embodiments remedy these deficiencies.

While various embodiments of the present invention have been described above, it should be understood that they have been presented by way of example only, and not limitation. It will be apparent to persons skilled in the relevant art that various changes in form and detail can be made therein without departing from the spirit and scope of the invention.

What is claimed is:

1. A system, comprising:

an adaptive noise cancellation sub-system, wherein the system is configured to adjust operation of the sub-system from a first operating state to a second operating state upon a determination that operation of the adaptive noise cancellation sub-system will be affected by an own voice body conducted noise phenomenon, wherein the sub-system is configured to change to a first control regime from a second control regime upon the determination that operation of the adaptive noise cancellation sub-system will be affected by the own voice body conducted noise phenomenon, thereby adjusting operation of the adaptive noise cancellation from the first operating state to the second operating state, and wherein the second control regime is different from the first control regime.

2. The system of claim 1, wherein:

the first operating state is an operating state in which the system operates while the recipient of the system is speaking;

the adaptive noise cancellation sub-system cancels at least a portion of the own voice body conducted noise resulting from the speaking; and the adaptive noise cancellation sub-system is not significantly affected by an own voice body conducted noise phenomenon.

3. The system of claim 1, wherein:

the adaptive noise cancellation sub-system includes a signal filter sub-system, wherein the system is configured to control a filter coefficient of the signal filter sub-system to affect noise cancellation according to the first control regime when in the second operating state.

4. The system of claim 3, wherein the first control regime at least one of:

freezes the filter coefficient; or adjusts the filter coefficient to a different setting from that which would be the case in the absence of the first control regime.

5. The system of claim 1, wherein: the first operating state is an operating state in which the adaptive noise cancellation subsystem operates according to a first algorithm; and the second operating state is an operating state in which the adaptive noise cancellation sub-system operates in a deviant manner from the first algorithm.

6. The system of claim 5, wherein: the deviant manner includes at least one of suspension of execution of the first algorithm or exiting from the algorithm.

7. The system of claim 5, wherein: the first algorithm includes a sub-algorithm that controls the adaptive noise cancellation sub-system to operate in the deviant manner.

8. The system of claim 7, wherein: the system is configured such that the sub-algorithm is executed only upon the determination that the operation of the adaptive noise cancellation sub-system will be impacted by an own voice body conducted noise phenomenon.

9. The system of claim 1, wherein: wherein the control regime adjusts the filter coefficient to a different setting by at least one of: adjusting the filter coefficient to a predetermined value; or extrapolating a value of the filter coefficient.

10. The system of claim 1, wherein: the sub-system includes a signal filter sub-system, wherein the system is configured to control a filter coefficient of the signal filter sub-system to effect noise cancellation according to a first algorithm when the adaptive noise cancellation sub-system is in the first operating state; and the system is configured to control the filter coefficient of the signal filter sub-system that affects noise cancellation according to a control regime different from that of the first algorithm, thereby adjusting operation of the adaptive noise cancellation sub-system from the first operating state to the second operating state.

11. The system of claim 1, wherein: the second operating state is a state in which the adaptive noise cancellation sub-system cancels noise to a lesser degree than that of the first operating state.

12. The system of claim 1, wherein: the second operating state is a state in which the adaptive noise cancellation sub-system cancels at least body noise to a lesser degree than that of the first operating state.

13. The system of claim 1, wherein: the system is a cochlear implant hearing prosthesis system.

14. The system of claim 1, wherein: the system includes a microphone and an output transducer configured to evoke a hearing percept based on sound captured by the microphone; and the system is configured such that the adaptive noise cancellation sub-system, when in the second operating state, alters the output of the transducer based on the sound captured by the microphone such that the output is different from that which would be the case if the adaptive noise cancellation sub-system was in the first operating state.

15. The system of claim 1, wherein: the system is a hearing prosthesis system and the noise cancellation sub-system modifies an output of the hearing prosthesis system based on the operating state of the noise cancellation sub-system.

16. The system of claim 1, wherein: the system is configured to output energy to evoke a hearing percept, and the noise cancellation sub-system modifies the output energy based on the operating state of the noise cancellation sub-system.

* * * * *